US010826184B2

(12) United States Patent
Logan et al.

(10) Patent No.: US 10,826,184 B2
(45) Date of Patent: Nov. 3, 2020

(54) UNBALANCED SLOT APERTURE (USA) RADIATOR

(71) Applicant: The Government of the United States of America, as represented by the Secretary of the Navy, Arlington, VA (US)

(72) Inventors: John T. Logan, Alexandria, VA (US); Rick W. Kindt, Arlington, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/420,481

(22) Filed: May 23, 2019

(65) Prior Publication Data

US 2019/0363443 A1 Nov. 28, 2019

Related U.S. Application Data

(60) Provisional application No. 62/675,311, filed on May 23, 2018.

(51) Int. Cl.

| | |
|---|---|
| ***H01Q 13/10*** | (2006.01) |
| ***H01Q 9/06*** | (2006.01) |
| ***H01Q 21/00*** | (2006.01) |
| ***H01Q 9/04*** | (2006.01) |
| ***H01Q 5/25*** | (2015.01) |

(52) U.S. Cl.

CPC ..... *H01Q 9/065* (2013.01); *H01Q 5/25* (2015.01); *H01Q 9/0478* (2013.01); *H01Q 21/0025* (2013.01)

(58) Field of Classification Search

None

See application file for complete search history.

(56) References Cited

U.S. PATENT DOCUMENTS

| | | | |
|---|---|---|---|
| 6,323,809 | B1 | 11/2001 | Maloney et al. |
| 6,512,487 | B1 | 1/2003 | Taylor et al. |
| 8,325,093 | B2 | 12/2012 | Holland |
| 9,172,147 | B1 | 10/2015 | Manry, Jr. |
| 2008/0246680 | A1 | 10/2008 | Rawnick et al. |
| 2010/0007572 | A1 | 1/2010 | Jones et al. |

(Continued)

OTHER PUBLICATIONS

International Search Report for PCT/US2016/19569 from the International Searching Authority, dated Jul. 18, 2016.

(Continued)

*Primary Examiner* — Anh Q Tran

(74) *Attorney, Agent, or Firm* — US Naval Research Laboratory; William Ladd

(57) ABSTRACT

Systems and methods are provided for Planar Ultrawideband Modular Antenna (PUMA) arrays that use slots as primary radiating mechanisms. Slot-based PUMA arrays in accordance with an embodiment of the present disclosure can achieve approximately the same performance as dipole-based PUMA arrays. Systems and methods according to embodiments of the present disclosure enable wideband slot-based antenna arrays that can be planar printed using etched metallic traces and plated through vias, have a single input per unit cell, and have unit cells that are coupled to radiating slot(s) that are continuous across multiple unit cells.

20 Claims, 23 Drawing Sheets

(56) References Cited

U.S. PATENT DOCUMENTS

| | | | | |
|---|---|---|---|---|
| 2010/0109966 | A1 | 5/2010 | Mateychuk et al. | |
| 2012/0146869 | A1* | 6/2012 | Holland | H01Q 21/061 343/795 |
| 2013/0321231 | A1 | 12/2013 | Flores-Cuadras | |
| 2018/0040955 | A1* | 2/2018 | Vouvakis | H01Q 5/42 |

OTHER PUBLICATIONS

European Search Report for European Patent Application 16756361.8, dated Aug. 27, 2018.

Logan et al., "Planar Ultrawideband Modular Antenna (PUMA) arrays scalable to mm-waves," IEEE Antennas and Propagation Society International Symposium (APSURSI), dated Jul. 2013.

Logan et al., "On the design of 6:1 mm-wave PUMA arrays," IEEE Antennas and Propagation Society International Symposium (APSURSI), dated Jul. 2013.

Logan et al., "Opportunities and advances in ultra-wideband electronically scanned arrays," IEEE Antennas and Propagation Society International Symposium (APSURSI), dated Jul. 2016.

Logan et al., "A review of Planar Ultrawideband Modular Antenna (PUMA) Arrays," 2013 International Symposium on Electromagnetic Theory, dated Jul. 2013.

Guo et al., "Broadband 60-GHz beam-steering vertical off-center dipole antennas in LTCC," IEEE International Workshop on Antenna Technology (iWAT), dated Mar. 2012.

* cited by examiner

UNBALANCED SLOT APERTURE (USA) RADIATOR

CROSS REFERENCE TO RELATED APPLICATIONS

This application claims the benefit of U.S. Provisional Patent Application No. 62/675,311, filed on May 23, 2018, which is incorporated by reference herein in its entirety.

FIELD OF THE DISCLOSURE

This disclosure relates to antennas, including ultrawideband antennas.

BACKGROUND

Ultrawideband (UWB) phased array antenna apertures are in high demand for commercial 5G telecomm and Navy multifunctional and electronic warfare systems. Typical flared notch apertures are heavy, thick, expensive, and can suffer from polarization control limitations. Planar Ultrawideband Modular Antenna (PUMA) antenna apertures provide are affordable, low-profile, low cross-polarization, UWB planar-printed dipole-based antenna apertures manufactured using standard microwave printed circuit board technologies.

BRIEF DESCRIPTION OF THE DRAWINGS/FIGURES

The accompanying drawings, which are incorporated in and constitute part of the specification, illustrate embodiments of the disclosure and, together with the general description given above and the detailed descriptions of embodiments given below, serve to explain the principles of the present disclosure. In the drawings.

Figure 1A:
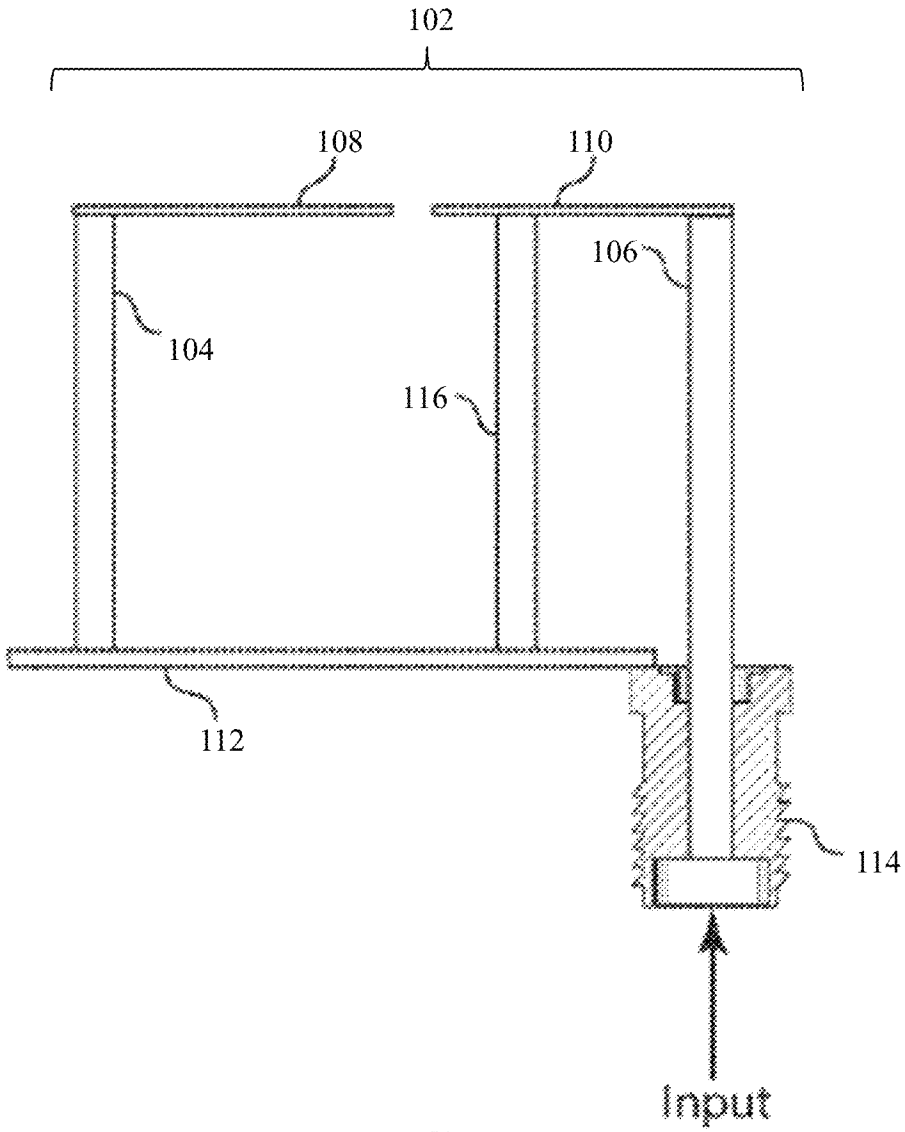
FIG. 1A is a cross-section diagram of a unit cell of an exemplary dipole-based Planar Ultrawideband Modular Antenna (PUMA) array having a shorting post on the fed dipole arm for common-mode mitigation.

Features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

In the following description, numerous specific details are set forth to provide a thorough understanding of the disclosure. However, it will be apparent to those skilled in the art that the disclosure, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to understand that such description(s) can affect such feature, structure, or characteristic in connection with other embodiments whether or not explicitly described.

1. OVERVIEW

Slot antennas are related to dipole antennas in terms of electrical performance via a complementary relationship. Planar Ultrawideband Modular Antenna (PUMA) arrays were based off of dipoles as radiators. Embodiments of the present disclosure modify PUMA arrays to use slots as primary radiating mechanisms. Slot-based PUMA arrays in accordance with an embodiment of the present disclosure can achieve approximately the same performance as dipole-based PUMA arrays (e.g., in an embodiment, due to their complementary impedance relationship). In an embodiment, a slot-based PUMA array can be termed an Unbalanced Slot Aperture (USA) radiator because, for example, it can be seen that the primary structure resembles a slot (e.g., as opposed to dipoles) and is fed with a typical unbalanced radio frequency (RF) feed (e.g., coaxial cable) that is capacitively coupled to the slot.

2. EXEMPLARY DIPOLE-BASED PUMA ARRAYS

Dipole-based PUMA arrays can be modular and use a dual-offset dual-polarized lattice of horizontal segments directly fed with a standard unbalanced RF interface. Some conventional dipole-based arrays use plated vias to directly connect the fed radiating arms of the array to the ground plane. In an embodiment using dipole-based PUMA arrays, these plated vias are removed, and instead a metallic plate is capacitively coupled to the dipole segments and pinned to the ground plane with a plated via, as discussed in more detail below. This implementation of a PUMA array avoids the induction of low-frequency limiting loop modes that are prevalent in conventional PUMA arrays, while also mitigating disruptive common-modes. The conventional PUMA array may be considered as a limiting case of the feed being directly shorted/looped back to ground, whereas certain aspects and embodiments use different arrangements of vias, as discussed further below, to allow for a more broad interpretation of the PUMA concept in which the feed arm of the radiator can be more selectively looped back to ground using tuned circuitry (such as capacitors).

Additionally, according to certain embodiments, metallic ribs are attached to the fed and grounded lines beneath the horizontal dipole segments and oriented towards one another to enhance capacitive coupling and improve impedance performance in the transition from the feed circuits to the dipole traces. The heightened capacitance between the dipoles and feed lines also enables wider trace-trace gaps, via-to-via distances, via diameter-to-height aspect ratios, and thicker dielectric materials to be utilized that satisfy PCB standard manufacturing tolerances up to approximately Q-band (50 GHz).

In an embodiment, PUMA arrays retain the practical mechanical benefits of conventional arrays (e.g., modularity, direct unbalanced feeding, planar fabrication, low-profile, etc.) while doubling the bandwidth (3:1 to 6:1) to yield a fractional bandwidth of 143% (as opposed to 100%). An additional attractive feature of the PUMA array according to certain aspects and embodiments is that its frequency operation can extend up to the grading lobe frequency (i.e. $D_x=D_y=\lambda/2$ for scanned arrays, where $D_x$ and $D_y$ are the array periodicity in the lateral dimension and $\lambda$, is the free space wavelength), thus optimally sampling the array aperture, which implies the use of the least number of elements and electronics. The fully planar topology of embodiments of the PUMA arrays disclosed herein enables standard microwave/millimeter-wave fabrication to produce low-cost, low-profile ($\lambda_h/2$, where $\lambda_h$ is the highest frequency wavelength), modular UWB-ESAs with a competitive 6:1 bandwidth.

FIG. 1A is a cross-section diagram of a unit cell of an exemplary dipole-based Planar Ultrawideband Modular Antenna (PUMA) array having a shorting post on the fed dipole arm for common-mode mitigation. In FIG. 1A, via 104 (e.g., in an embodiment, a plated metallic via) connects arm 108 to ground plane 112, and additional via 106 (e.g., in an embodiment, a plated metallic via) connects arm 110 to inner-conductors of standard RF connector 114. Together, vias 104 and 106 function as vertical transmission lines to excite the radiating printed arms 108 and 110. Additional via 116 (e.g., in an embodiment, a plated metallic via) directly connects the fed horizontal segment of arm 110 to ground plane 112. In the conventional PUMA configuration as shown in FIG. 1A, the direct-connection balun provided by via 116 is necessary to prevent a disruptive common mode from developing on the feed lines of vias 104 and 106. This prevented further enhancement of conventional arrays in terms of bandwidth, despite its mechanical and fabrication advantages.

Figure 1B:
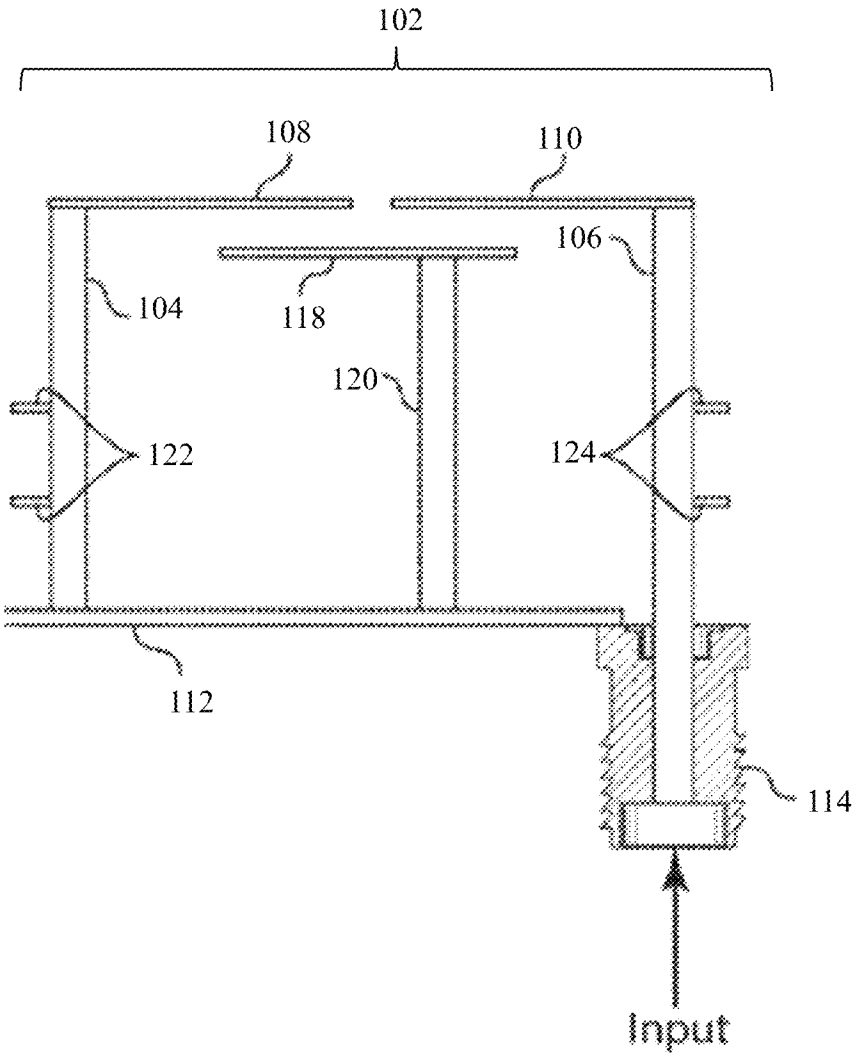
FIG. 1B is a diagram of a unit cell of an exemplary dipole-based PUMA array having a plate attached to a shorting post that is capacitively-coupled to the dipole arms for common-mode mitigation and improved operational bandwidth.

In an embodiment, PUMA arrays retain all the practical and mechanical advantages of conventional arrays, but considerably enhance the electrical performance and frequency scalability by overcoming the limitations of conventional arrays through the incorporation of various structural features. In particular, certain embodiments avoid the need for via 116 present in the array of FIG. 1A, instead replacing it with the use of a capacitively-coupled via structure and mechanism, as shown in FIG. 1B, for example, for common-mode mitigation without bandwidth limitations. Certain examples further include a capacitive plate for enhanced low-end bandwidth and relaxed fabrication tolerances, as discussed further below. Additionally, feed line ribs can be included for improved overall matching and relaxed fabrication tolerances, as also discussed below.

FIG. 1B is a diagram of a unit cell of an exemplary dipole-based PUMA array having a plate attached to a shorting post that is capacitively-coupled to the dipole arms for common-mode mitigation and improved operational bandwidth. In FIG. 1B, via 116 of the conventional array of FIG. 1A has been removed and replaced instead with a plate 118 (e.g. a metallic plate). In an embodiment, plate 118 is capacitively coupled to the fed PUMA arms 108 and 110 and is pinned to the ground plane 112 by via 120 (e.g., in an embodiment, a plated metallic via). In an embodiment, plate 118 is registered beneath (or above in some embodiments) arms 108 and 110 spaced at a distance specific to each particular embodiment and frequency operation.

Device performance can be tuned by the shape and placement of plate 118 and via 120 based on how plate 118 and via 120 couple to feed arm 110 and ground arm 108 of the PUMA unit cell of FIG. 1B. Vias 104 and 106 can be utilized to form a vertical two-wire transmission line that brings the RF signal from RF connector 114 or transmission line to arms 108 and 110. In one example, via 104 is directly connected to the ground plane 112 and via 106 is directly connected to the signal terminal of RF connector 114 (e.g., coaxial cable, stripline, microstrip, etc.). It is noted that via 106 does not need to be directly connected to arm 110; however, in this case strong capacitive coupling between via 106 and arm 110 is used for appropriate operation.

Via 120 may be used to directly connect plate 118 to ground plane 112. Additionally, in some embodiments, "ribs" 122 and 124 (e.g., in an embodiment, metallic ribs) are attached to the feed and grounded lines of vias 104 and 106, respectively, beneath arms 108 and 110. Thus, the feed lines may be drilled through multiple layers to make connection with not only arms 108 and 110, but also to two or more ribs 122 and 124 printed on dielectric layers underneath the PUMA arm metallization layer. In FIG. 1B, ribs 122 and 124 are oriented towards one another to enhance capacitive coupling and improve impedance performance in the transition from the feed circuits to arms 108 and 110. The heightened capacitance between arms 108 and 110 and feed lines of vias 104 and 106 also allows wider feed via-to-via gaps and larger feed vias. For example, vias 104 and 106 can have aspect ratios that satisfy printed circuit board (PCB) standard manufacturing tolerances up to approximately Q-band (50 GHz).

Figure 1C:
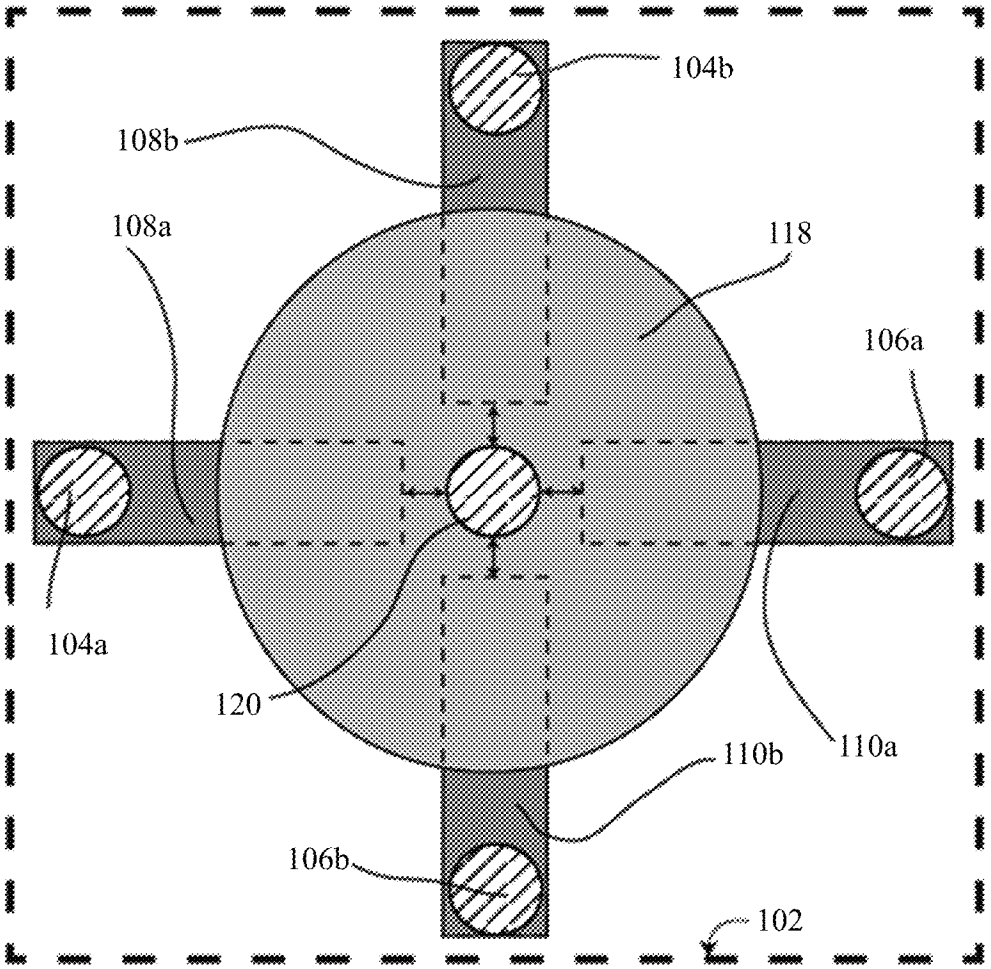
FIG. 1C is a diagram showing a top view of an exemplary configuration of a unit cell of an improved bandwidth dipole-based PUMA array.

FIG. 1C is a diagram showing a top view of an exemplary configuration of a unit cell of an improved bandwidth dipole-based PUMA array. As shown by FIG. 1C, a unit cell of a PUMA array can have multiple arms 108 and 110 and multiple vias 104 and 106. In FIG. 1C, arms 110*a* and 110*b* correspond to arm 110 of the unit cell diagram of FIG. 1B, and arms 108*a* and 108*b* correspond to arm 108 of the unit cell diagram of FIG. 1B. Further, in FIG. 1C, vias 106*a* and 106*b* correspond to via 106 of FIG. 1B, and vias 104*a* and 104*b* correspond to via 104 of FIG. 1B.

3. EXEMPLARY SLOT-BASED PUMA ARRAYS

Embodiments of the present disclosure provide PUMA arrays that use slots as primary radiating mechanisms (e.g., instead of using dipoles as primary radiating mechanisms as illustrated by FIGS. 1A-1C). Systems and methods according to embodiments of the present disclosure enable wideband slot-based antenna arrays that can be planar printed (e.g., using etched metallic traces and plated through vias), have a single input per unit cell, and have unit cells that are coupled to radiating slot(s) that are continuous across multiple unit cells. PUMA arrays (e.g., slot-based PUMA arrays) in accordance with embodiments of the present disclosure can deliver high electric performance while using high-volume printing processes for production of the arrays that rely on structures using planar traces and vias.

Figure 2:
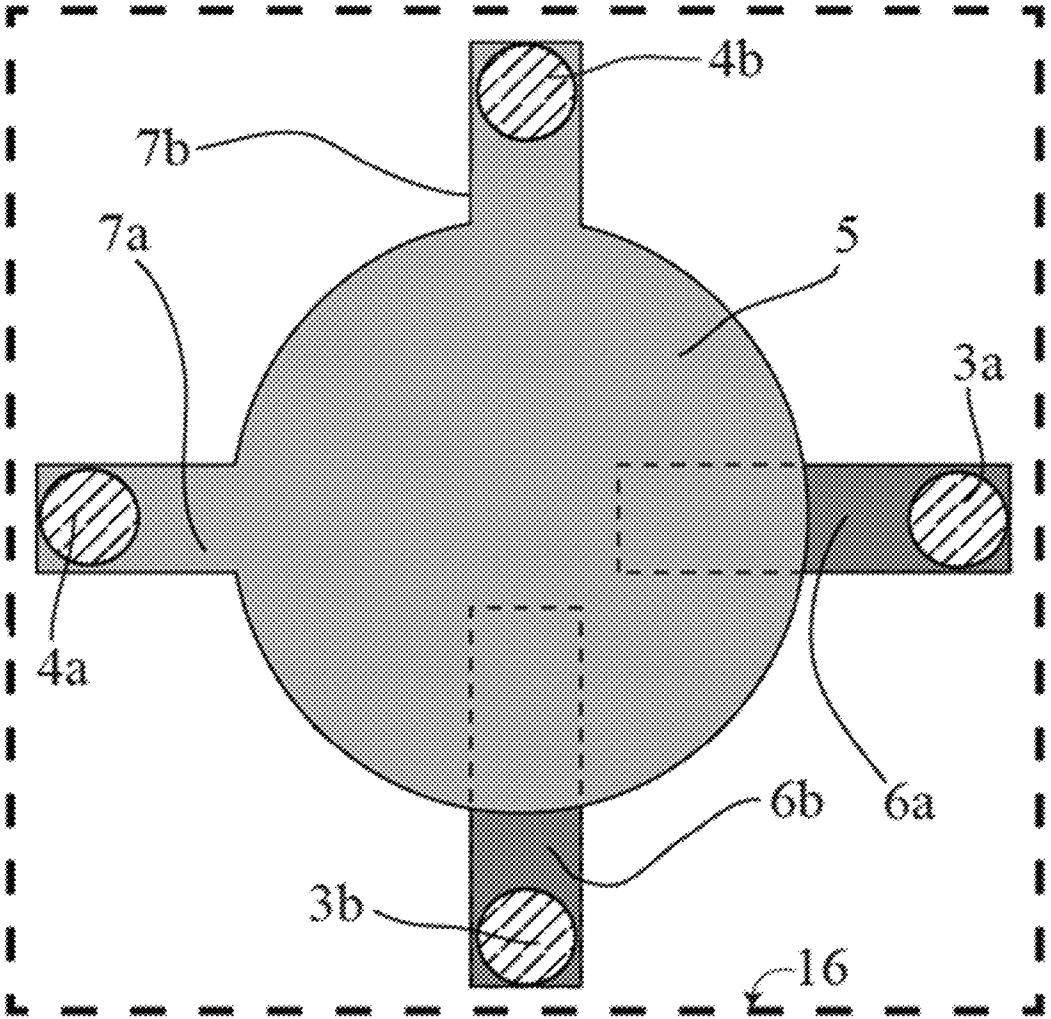
FIG. 2 is a diagram showing top-view diagram of an exemplary slot-based PUMA unit cell in accordance with an embodiment of the present disclosure.

FIG. 2 is a diagram showing top-view diagram of an exemplary slot-based PUMA unit cell 16 in accordance with an embodiment of the present disclosure. FIG. 2 includes a metallic layer comprising a plate (e.g., a metallic plate) and arms (e.g., printed arms) 7*a* and 7*b*, which are pinned to a ground plane 1 (shown in FIG. 3) by vias 4*a* and 4*b*. In FIG. 2, plate 5 is capacitively coupled to arms (e.g., printed arms) 6*a* and 6*b*), which are coupled to respective RF connectors through vias 3*a* and 3*b* (e.g., RF connector 19 shown in FIG. 3). For example, in an embodiment, both vias 3*a* and 3*b* can be used to transmit different RF signals to be radiated through respective horizontal and vertical slots of the unit cell (see, e.g., FIG. 19 labeling exemplary horizontal and vertical slots of a dual polarized PUMA array). In FIG. 2, arms 6*a* and 6*b* are shown positioned below plate 5. However, it should be understood that other orientations are possible and, in an embodiment, plate 5 can be positioned below arms 6*a* and 6*b*, on the side of arms 6*a* and 6*b*, etc.

Figure 4:
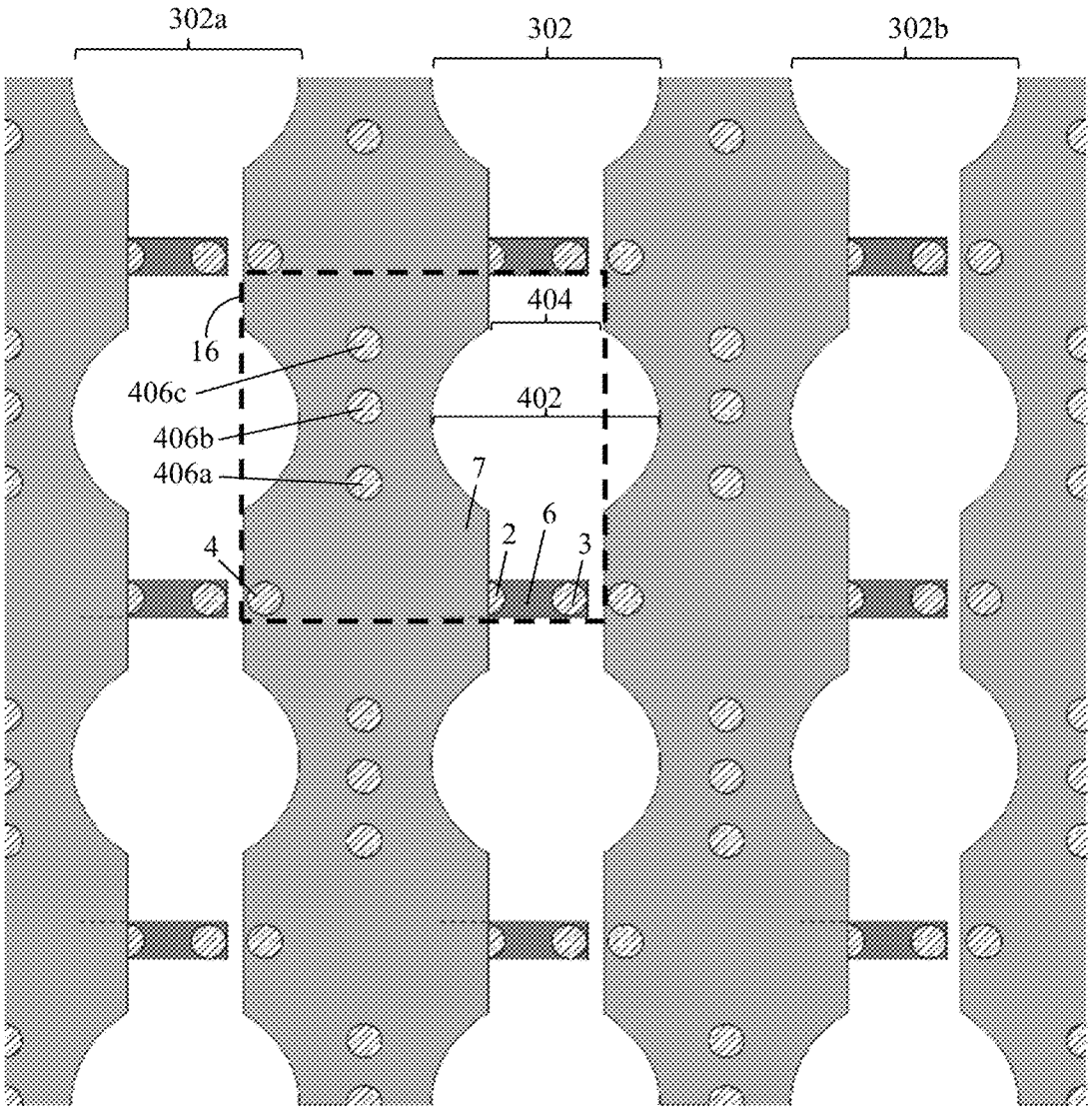
FIG. 4 is a top-view of multiple unit cells of a single-polarized slot-based PUMA array in accordance with an embodiment of the present disclosure.

Elements in FIG. 2 are configured differently from corresponding elements in FIG. 1C to enable the unit cell 16 of FIG. 2 to function as a unit cell of a slot-based PUMA array. For example, in FIG. 1C, plate 118 is on a different planar layer from arms 108*a*, 108*b*, 110*a*, and 110*b*. In FIG. 2, a continuous piece of metal comprising plate 5, arm 7*a*, and arm 7*b* is formed on a planar layer. In an embodiment, this continuous piece of metal forming plate 5 and arms 7*a* and 7*b* can stretch across multiple unit cells and can capacitively couple to respective arms of other unit cells (e.g., as shown in FIG. 4). Depending on its configuration in various embodiments of the present disclosure, the continuous piece of metal forming plate 5 and arms 7*a* and 7*b* is referred to herein as plate 5 and/or arm 7.

A significant difference between dipole-based PUMAs and slot-based PUMAs in an embodiment of the present disclosure is that all metallizations in a slot-based PUMA array that are grounded (e.g., metallizations for plate 5, arm 7*a*, and arm 7*b*) are connected together. In an embodiment, since all metallizations share the same ground connection, connecting all metallizations does not significantly impact performance. In an embodiment, connecting grounded metallizations together prohibits available module split planes such that the antenna element cannot be split apart at the original dipole end points for convenience in assembly and/or maintenance without disrupting electrical performance of the antenna element. The antenna element can still be modular at the feed points (e.g., at RF connector 19).

Figure 3:
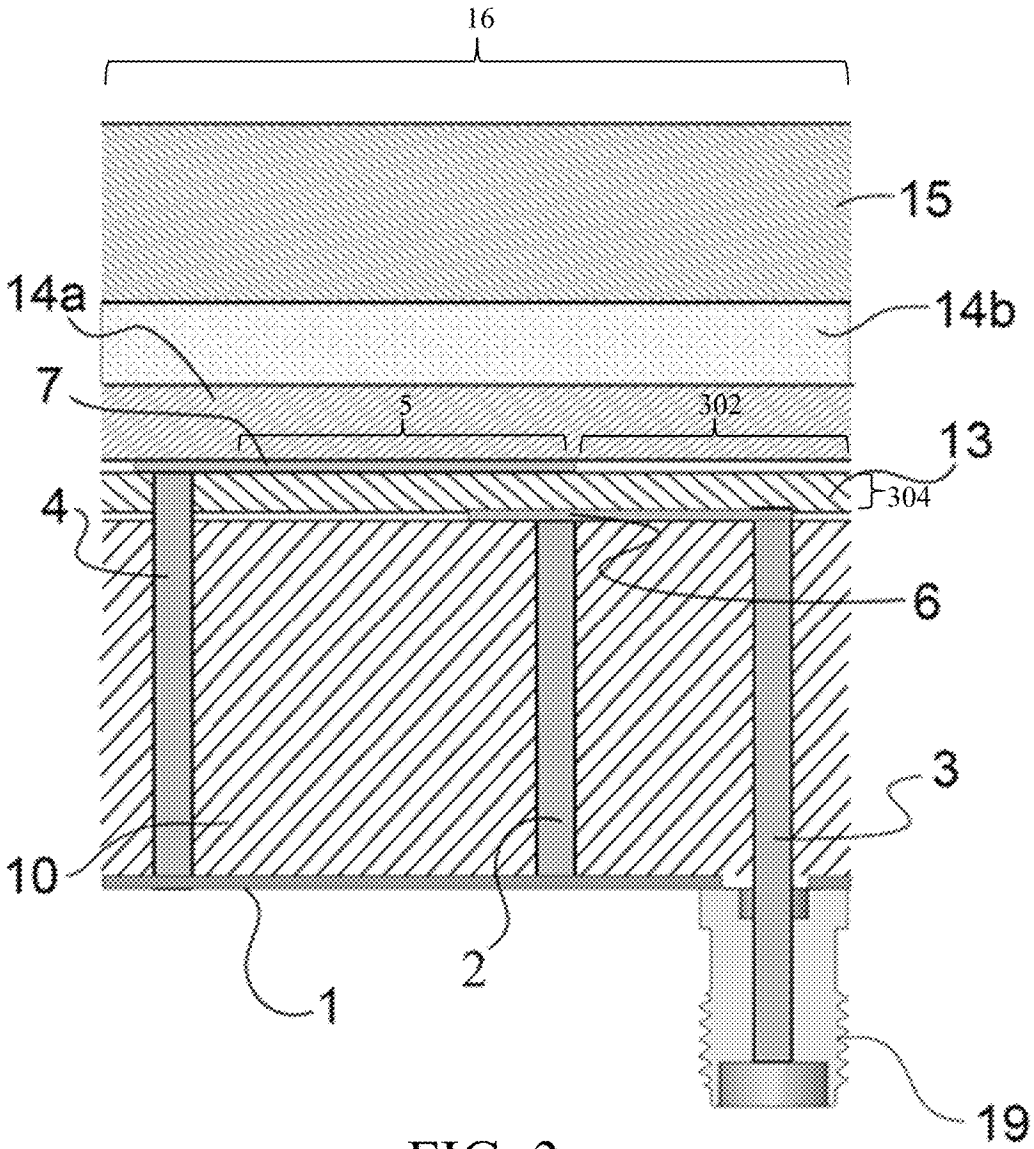
FIG. 3 is a cross section of an exemplary slot-based PUMA unit cell in accordance with an embodiment of the present disclosure.

FIG. 3 is a cross section of an exemplary slot-based PUMA unit cell in accordance with an embodiment of the present disclosure. In FIG. 3, arm 6 is coupled to RF connector 19 through via 3 and to ground plane 1 through via 2, and arm 7 is coupled to ground plane 1 through via 4. In an embodiment, a superstrate is placed on top of the planar layer containing arm 7 in unit cell 16. The superstrate layer can contain a variety of numbers of sub-layers in accordance with embodiments of the present disclosure. Sub-layer design (e.g., number of sub-layers in the superstrate layer, thickness of each sub-layer, material of each sub-layer, desired degrees of freedom, etc.) can be chosen, for example, based on tuning requirements of the antenna array and/or antenna array cell. In FIG. 3, the superstrate layer of unit cell 16 includes three sub-layers: sub-layer 14*a*, sub-layer 14*b*, and sub-layer 15.

As shown in FIG. 2 in greater detail, in an embodiment, plate 5 and arm 7 of a PUMA slot-based array are formed from a continuous piece of metal and are located in the same planar layer. In the cross-section of FIG. 3, part of the piece of metal used to form arm 7 also functions as plate 5, and plate 5 is capacitively coupled to arm 6 (e.g., via a gap 304 between plate 5 and arm 6). Although the cross-section of FIG. 3 shows only two arms (arm 6 and arm 7), it should be understood that unit cell 16 can contain more than two arms in accordance with embodiments of the present disclosure. For example, in an embodiment, plate 5 can be coupled to two arms (e.g., arms 7*a* and 7*b*, as shown in FIG. 2). In an embodiment, plate 5 can be capacitively coupled to two different arms (e.g., arms 6*a* and 6*b*, as shown in FIG. 2).

As discussed above, unit cell 16 of FIG. 3 is a unit cell of a slot-based PUMA array. Thus, in an embodiment, arms 6 and 7 of FIG. 3 are not used as radiating elements. Rather, in FIG. 3, slot 302 is used as a radiating element. For example, in an embodiment, unit cell 16 is powered through RF connector 19. In an embodiment, a signal travels from RF connector 19, through via 3, to arm 6, and a radiated signal is generated through the gap formed by slot 302. As discussed above, in an embodiment, unit cell 16 is part of an array of unit cells. Thus, in an embodiment, slot 302 is formed in the space between the continuous piece of metal forming arm 7 and metal for a corresponding arm in an adjacent unit cell (e.g., as shown in FIG. 4).

The signal amplitude, phase, frequency, power, etc. can be controlled by a variety of design parameters of unit cell 16 and/or the PUMA array comprising unit cell 16 as a whole in accordance with embodiments of the present disclosure. For example, in an embodiment, the width of plate 5, the width of the overlap of plate 5 onto arm 6, the height of gap 304, the width of slot 302, the input signal frequency, the input signal amplitude, etc. can affect the signal radiated from slot 302. For example, in an embodiment, if the width of plate 5 is shortened to reduce the overlap onto arm 6, the mutual capacitance of plate 5 and arm 6 can be reduced, and the lower operational frequency limit can be consequently increased, thus impeding the input signal from being effectively radiated at lower frequencies. For example, in an embodiment, if the width of slot 302 is narrowed near the feed point of RF connector 19, the impedance of slot 302 can be decreased to better match to the generally lower characteristic impedance of the feed (e.g., 50 ohms). For example, in an embodiment, if the width of slot 302 is widened away from the feed point of RF connector 19, the impedance of slot 302 can be increased to better match to a generally higher free-space impedance (e.g., 377 ohms).

Figure 14:
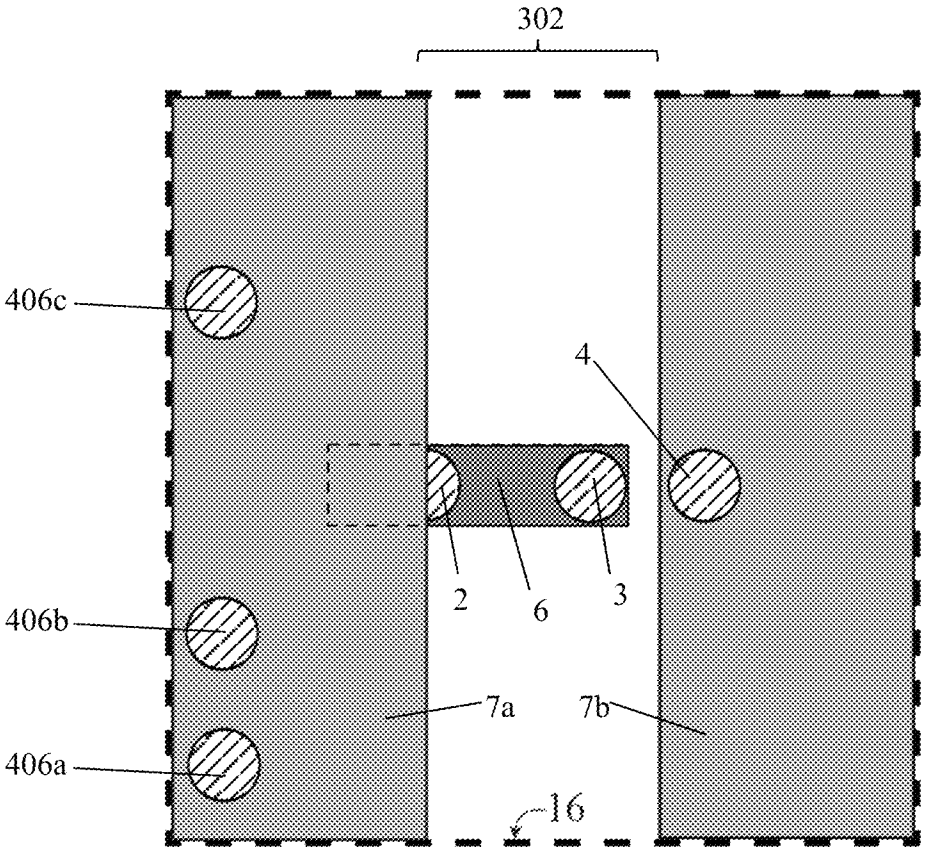
FIG. 14 is a diagram of a unit cell of a slot-based PUMA in accordance with an embodiment of the present disclosure.

FIG. 4 is a top-view of multiple unit cells of a single-polarized slot-based PUMA array in accordance with an embodiment of the present disclosure. In FIG. 4, unit cell 16 of the PUMA array is shown with dashed lines. In FIG. 4, slot 302 extends across unit cells of the PUMA array that are located above or below unit cell 16. Additional slots 302*a* and 302*b* are used to radiate signals from unit cells not above or below unit cell 16. As illustrated by FIG. 14, slots can have portions that increase and/or decrease in area across the length of the slot. For example, in FIG. 4, a first portion 402 of slot 302 has a greater width than a second portion 404 of slot 302. In an embodiment, first portion 402 of slot 302 is wider to provide increased impedance to assist with impedance matching to free-space.

In an embodiment, it is undesirable for there to be an electrical length of more than half-wavelength between grounded connections. For example, in an embodiment, if the distance between two grounded connections is large, unwanted resonances can be produced. In FIG. 4, additional grounded connections using vias 406*a*, 406*b*, and 406*c* are added to prevent unwanted resonances. Additionally, in an embodiment, vias 406*a*, 406*b*, and 406*c* can provide a more reliable ground (e.g., additional grounded connections for the metal forming plate 5 and arm 7 so as not to rely on via 4 as the only grounded connection for plate 5 and arm 7).

Figure 5:
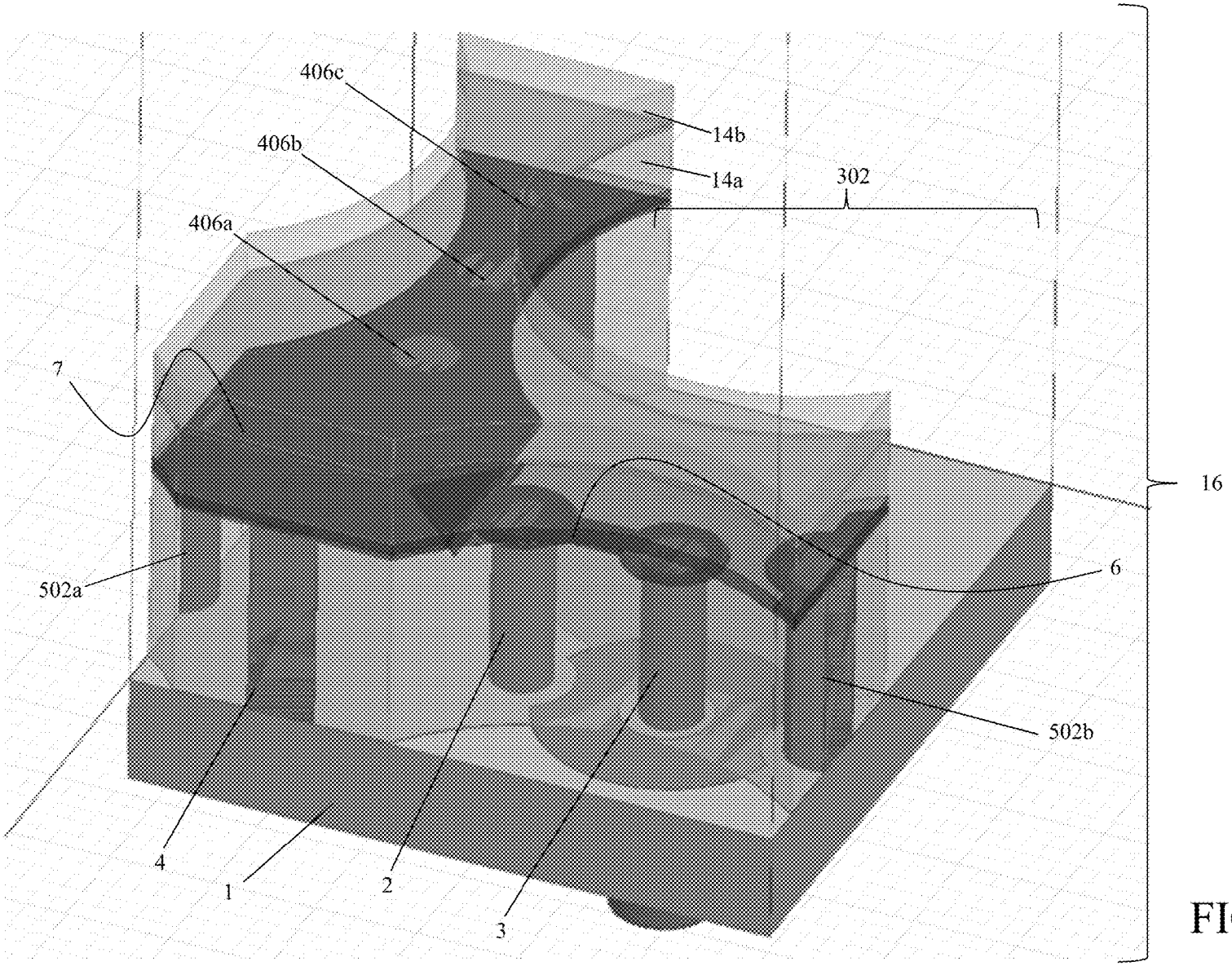
FIG. 5 is an isometric view of a computer aided design (CAD) model of a unit cell of a slot-based PUMA array in accordance with an embodiment of the present disclosure.

FIG. 5 is an isometric view of a computer aided design (CAD) model of a unit cell of a slot-based PUMA array in accordance with an embodiment of the present disclosure. In an embodiment, the entire material stack-up of unit cell 16, in addition to slot 302, may be perforated as shown here, forming a cylindrical air gap extending from slot 302 vertically through superstrate layers of the unit cell (e.g., superstrate sub-layers 14*a* and 14*b*). In an embodiment, this perforation forms a barbell-like slot across multiple unit cells, as shown by FIG. 4 by slots 302, 302*a*, and 302*b*. In an embodiment, the cylindrical perforation also benefits wide-angle scanning. Note that ground plane 1 (e.g., a metallic ground plane) is thick in FIG. 5 and not perforated. In an embodiment, thick ground plane 1 of FIG. 5 forms a backing reflector that, for example, improves antenna gain and helps shield backing electronics from electromagnetic interference. It is noted that there can be a plurality of perforation shapes/sizes and material layers to be perforated in accordance with embodiments of the present disclosure.

In an embodiment, unit cell 16 can include an additional via so that unit cell 16 better emulates a solid piece of metal. In an embodiment, this can be done by placing one or more additional vias at the edges of arm 7. For example, in FIG. 5, a portion 502*a* of this additional via can be seen connected to arm 7 and parallel with vias 2 and 3. In FIG. 5, another portion 502 of a via coupled to an arm of an adjacent unit cell is also shown. In an embodiment, vias are spaced a quarter-wavelength apart. For example, in an embodiment, vias 2, 3, and the via forming portion 502*b* are spaced a quarter-wavelength apart. In an embodiment, vias 406*a*, 406*b*, and 406*c* are spaced approximately a quarter-wavelength apart.

4. EXEMPLARY EMBODIMENTS ILLUSTRATED BY TOP DOWN VIEWS

Figure 6:
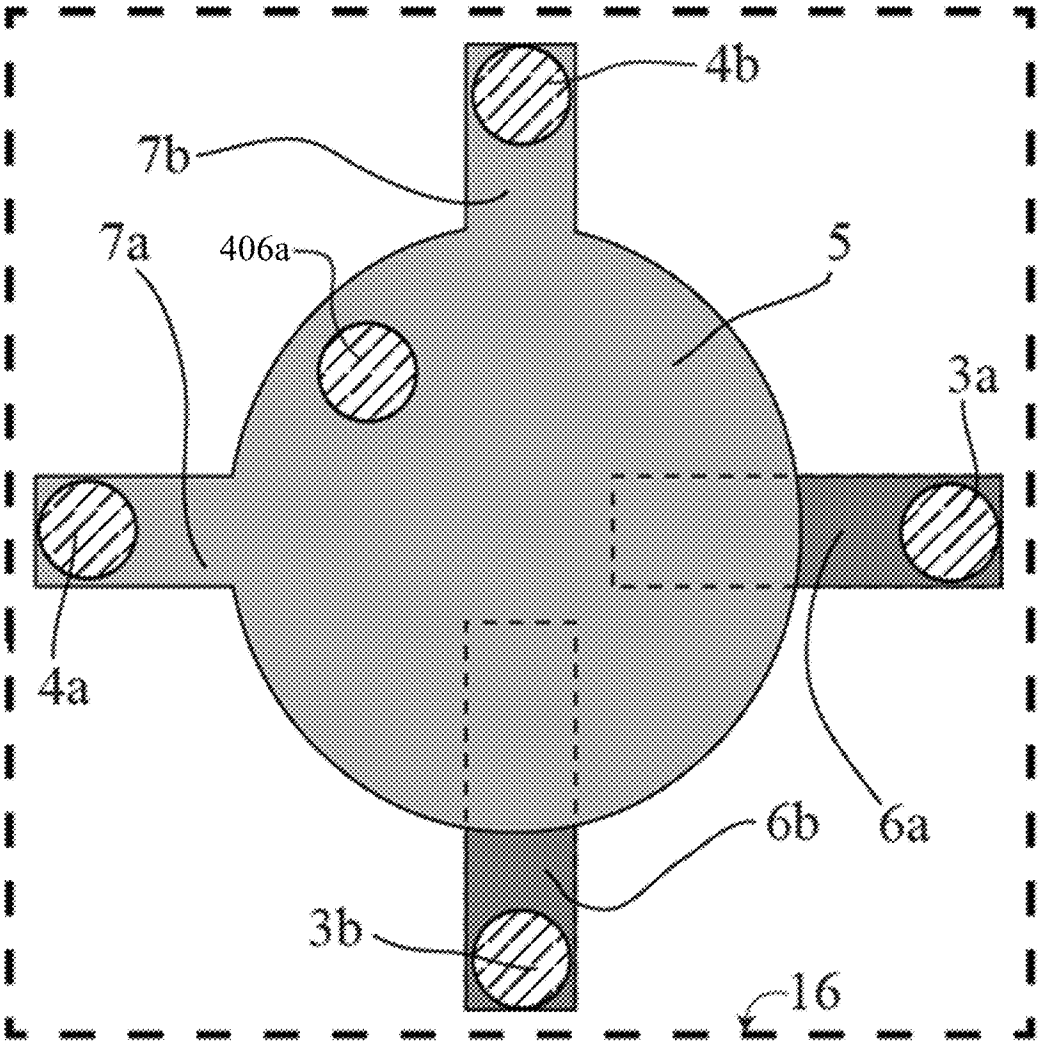
FIG. 6 is a top-down diagram of an exemplary slot-based PUMA in accordance with an embodiment of the present disclosure.

FIG. 6 is a top-down diagram of an exemplary slot-based PUMA in accordance with an embodiment of the present disclosure. As discussed above (e.g., with reference to FIG. 4), the continuous piece of metal used to form plate 5 and arms 7*a* and 7*b* can be grounded using additional vias (e.g., 406*a*, 406*b*, and 406*c* in FIG. 4) to prevent unwanted resonances. In FIG. 6, a single additional via 406*a* is shown. As shown in FIG. 6, via 406*a* may be offset from the center position (e.g., as compared to the position of via 406*a* in FIG. 4). In an embodiment, the position of via 406*a* is arbitrary, and via 406*a* can be placed nearer to dipole arms 6*a* and 6*b*, or (in this case) further away from dipole arms 6*a* and 6*b*.

Figure 7:
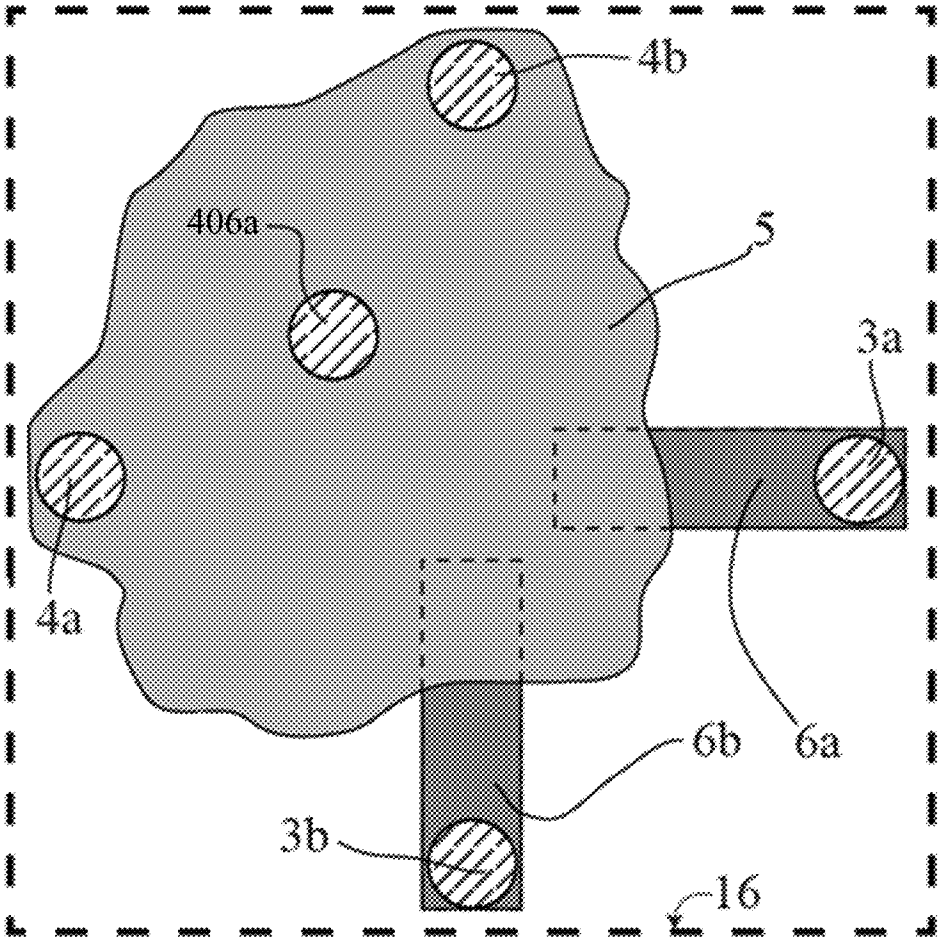
FIG. 7 is a top-down diagram of an exemplary slot-based PUMA in accordance with an embodiment of the present disclosure.

FIG. 7 is a top-down diagram of an exemplary slot-based PUMA in accordance with an embodiment of the present disclosure. In FIG. 7, plate 5 has become so large such that arms 7*a* and 7*b* and plate 5 now physically represent one large plate structure.

Figure 8:
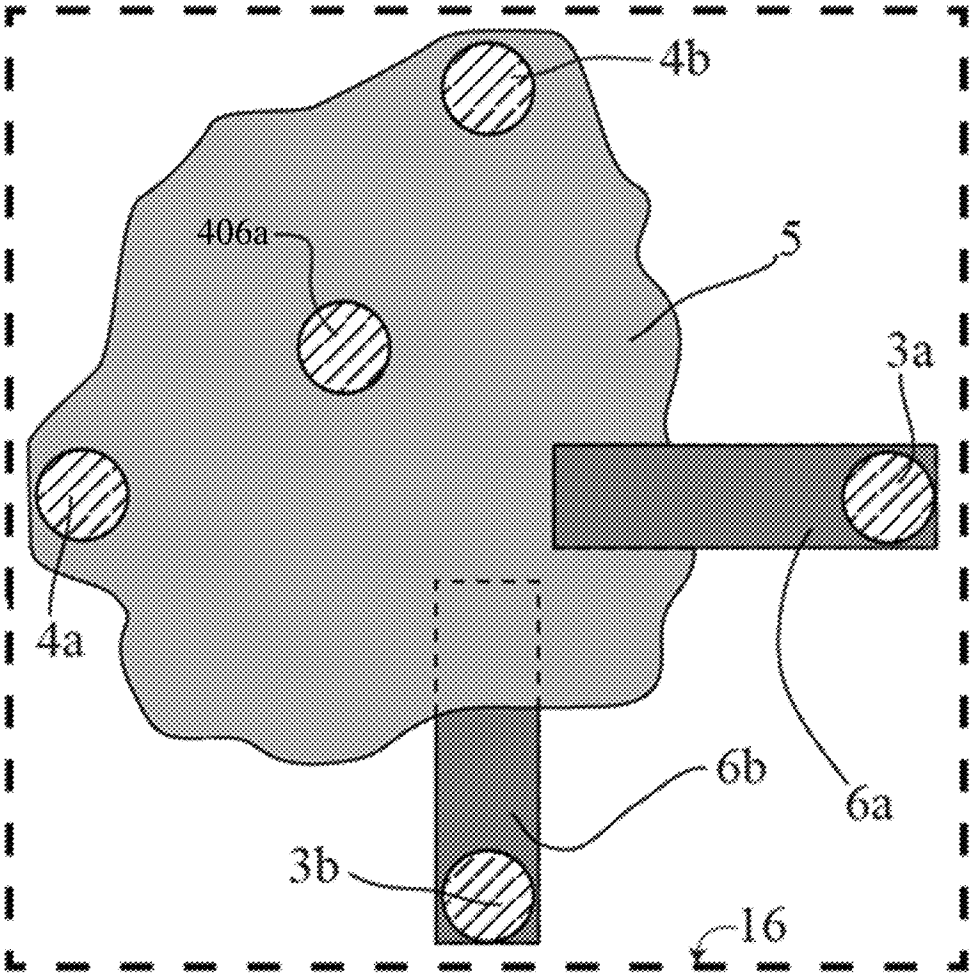
FIG. 8 is a top-down diagram of an exemplary slot-based PUMA in accordance with an embodiment of the present disclosure.

FIG. 8 is a top-down diagram of an exemplary slot-based PUMA in accordance with an embodiment of the present disclosure. In FIG. 8, plate 5 has become so large such that arms 7*a* and 7*b* and plate 5 now physically represent one large grounded metallic plate structure. Further, in FIG. 8, excited dipole arm 6*a* and its excitation via 3*a* now reside above the planar layer that the grounded plate metallization for plate 5 is on.

Figure 9:
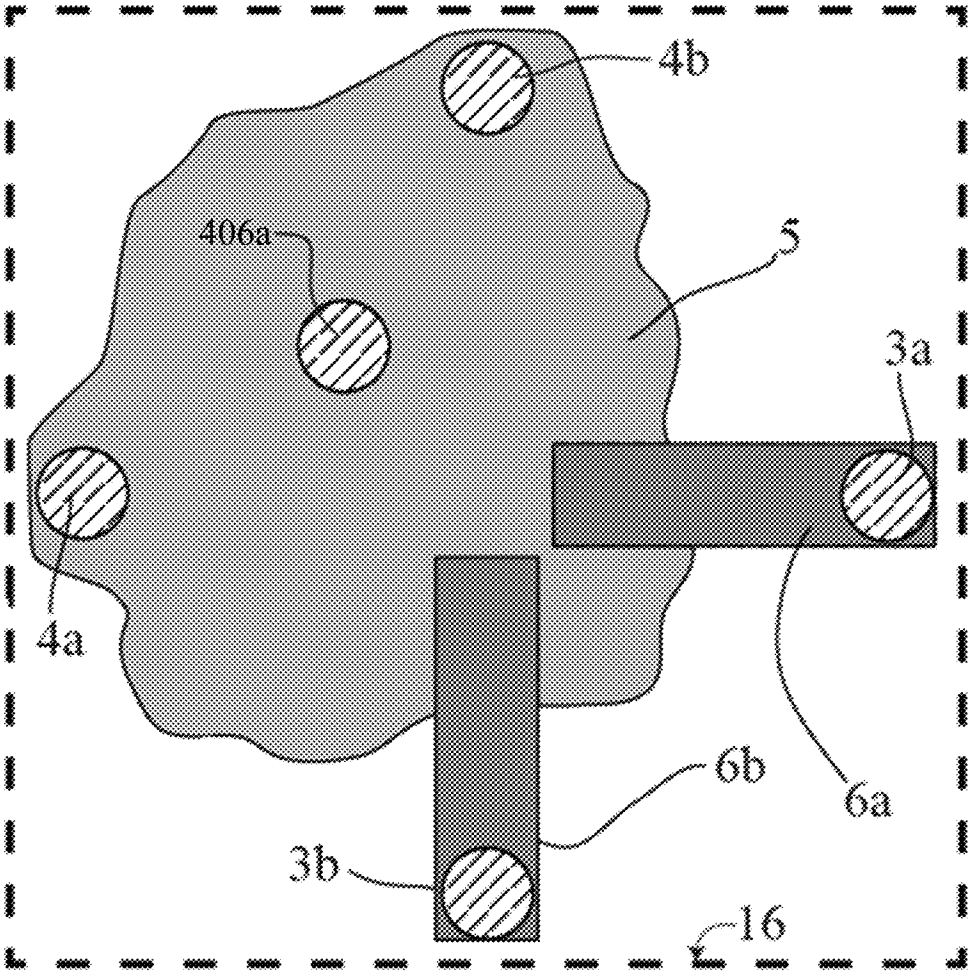
FIG. 9 is a top-down diagram of an exemplary slot-based PUMA in accordance with an embodiment of the present disclosure.

FIG. 9 is a top-down diagram of an exemplary slot-based PUMA in accordance with an embodiment of the present disclosure. In FIG. 9, plate 5 has become so large such that arms 7*a* and 7*b* and plate 5 now physically represent one large grounded metallic plate structure. Further, in FIG. 9, excited dipole arms 6*a* and 6*b* and their respective excitation vias 3*a* and 3*b* now reside above the planar layer that the grounded plate metallization for plate 5 is on.

Figure 10:
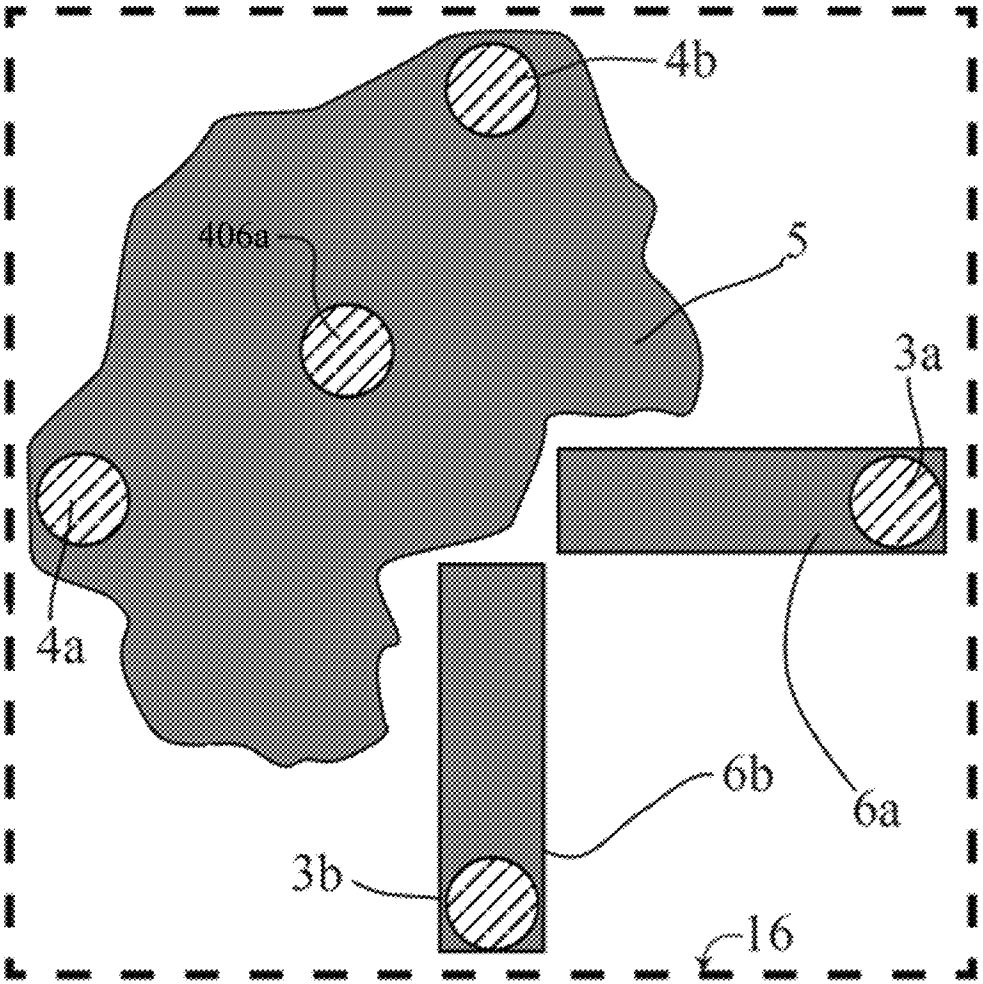
FIG. 10 is a top-down diagram of an exemplary slot-based PUMA in accordance with an embodiment of the present disclosure.

FIG. 10 is a top-down diagram of an exemplary slot-based PUMA in accordance with an embodiment of the present disclosure. In FIG. 10, plate 5 has become so large such that arms 7*a* and 7*b* and plate 5 now physically represent one large grounded metallic plate structure. Further, in FIG. 10, excited dipole arms 6*a* and 6*b* and their respective excitation vias 3*a* and 3*b* now reside on the same layer that the grounded plate metallization for plate 5 is on.

Figure 11:
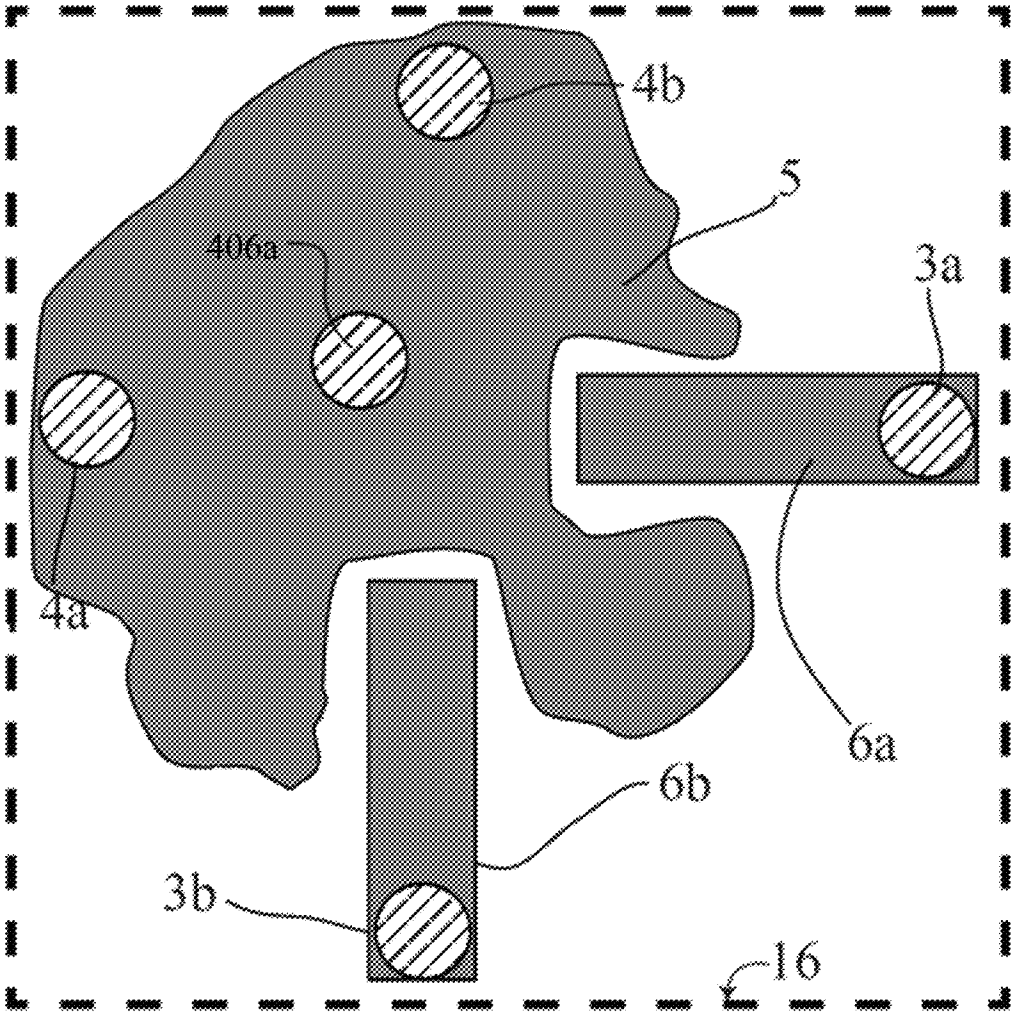
FIG. 11 is atop-down diagram of an exemplary slot-based PUMA in accordance with an embodiment of the present disclosure.

FIG. 11 is a top-down diagram of an exemplary slot-based PUMA in accordance with an embodiment of the present disclosure. In FIG. 11, plate 5 has become so large such that arms 7*a* and 7*b* and plate 5 now physically represent one large grounded metallic plate structure. In FIG. 11, excited dipole arms 6*a* and 6*b* and their respective excitation vias 3*a* and 3*b* now reside on the same layer that the grounded plate metallization for plate 5 is on. In an FIG. 11, plate 5 can protrude between arms 6*a* and 6*b*.

Figure 12:
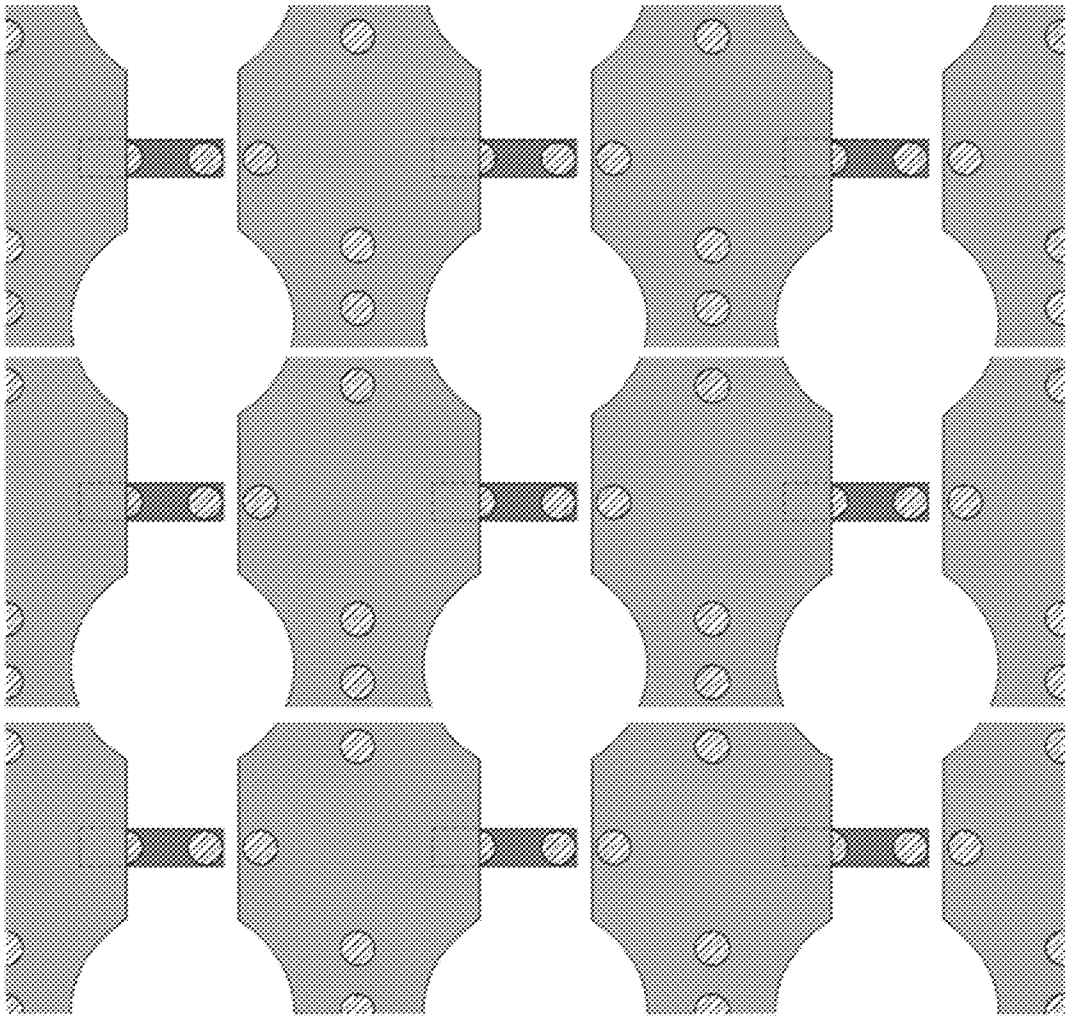
FIG. 12 is a top-view of multiple unit cells of a single-polarized slot-based PUMA array in accordance with an embodiment of the present disclosure.

FIG. 12 is a top-view of multiple unit cells of a single-polarized slot-based PUMA array in accordance with an embodiment of the present disclosure. In FIG. 12, a 3×3 embodiment of an array of slot-based PUMA unit ells with orthogonal split plane disconnections is shown.

Figure 13:
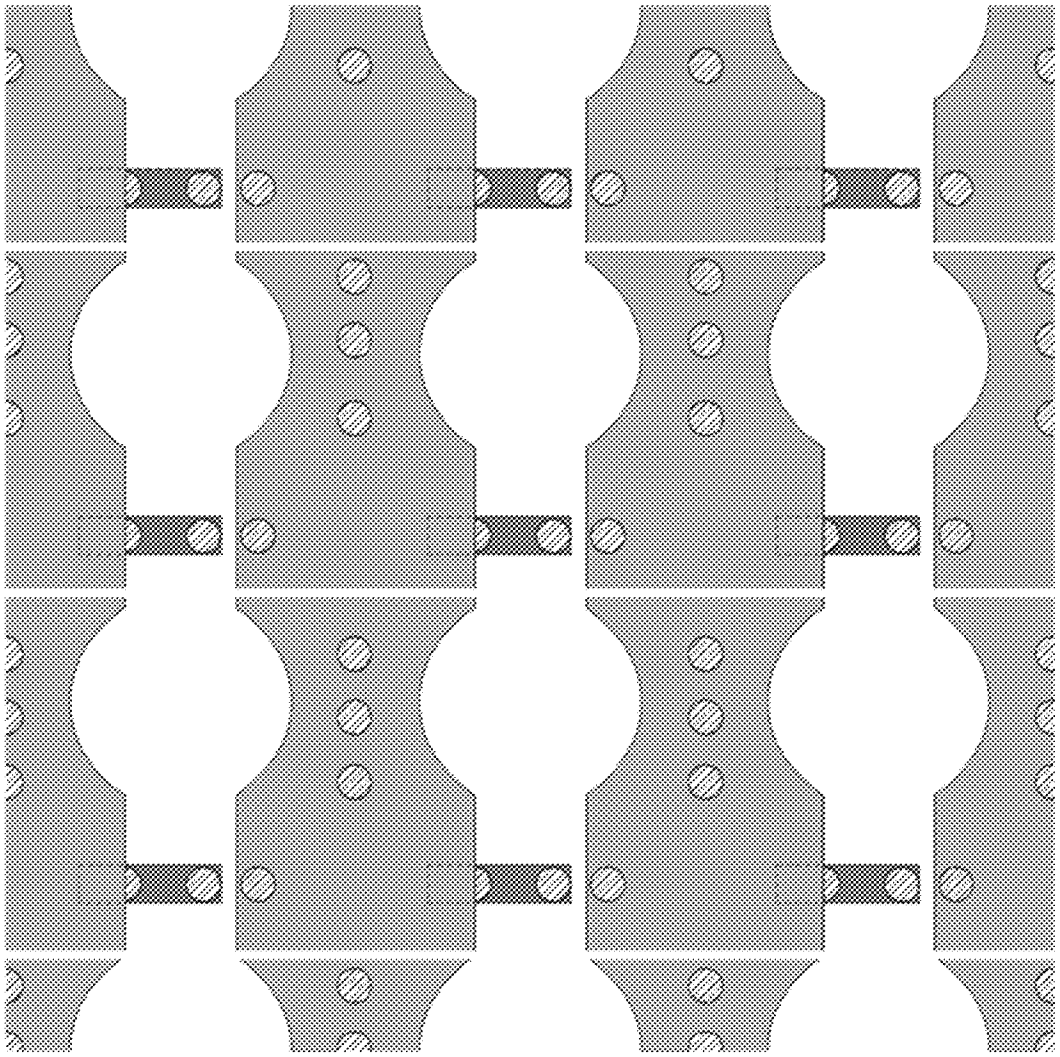
FIG. 13 is a top-view of multiple unit cells of a single-polarized slot-based PUMA array in accordance with an embodiment of the present disclosure.

FIG. 13 is a top-view of multiple unit cells of a single-polarized slot-based PUMA array in accordance with an embodiment of the present disclosure. In FIG. 12, a 3×3 embodiment of an array of slot-based PUMA unit ells with orthogonal split plane disconnections is shown. In FIG. 13, the disconnections are in a different position than the disconnections shown in FIG. 12. As illustrated by FIGS. 12 and 13, PUMA unit cells can be divided in a variety of ways in accordance with embodiments of the present disclosure.

5. EXEMPLARY SINGLE POLARIZATION EMBODIMENTS

FIGS. 14-17 are diagrams of exemplary slot-based PUMA unit cells in accordance with embodiments of the present disclosure. As described above, a PUMA array can be divided into unit cells in a variety of ways. In FIGS. 14-17, slot 302 is positioned at the center of unit cell 16. Additionally, in FIGS. 14-17, metal for two different arms 7*a* and 7*b* appears on each side of slot 302.

FIG. 14 is a diagram of a unit cell of a slot-based PUMA in accordance with an embodiment of the present disclosure. In FIG. 14, a single-polarization operation is supported within unit cell 16. A contiguous plate 5, grounded by at least one grounding via 2, is present. A single excited dipole arm 6 on a separate layer couples to the plate 5. Arm 6 may also have its own grounded via in this instance.

Figure 15:
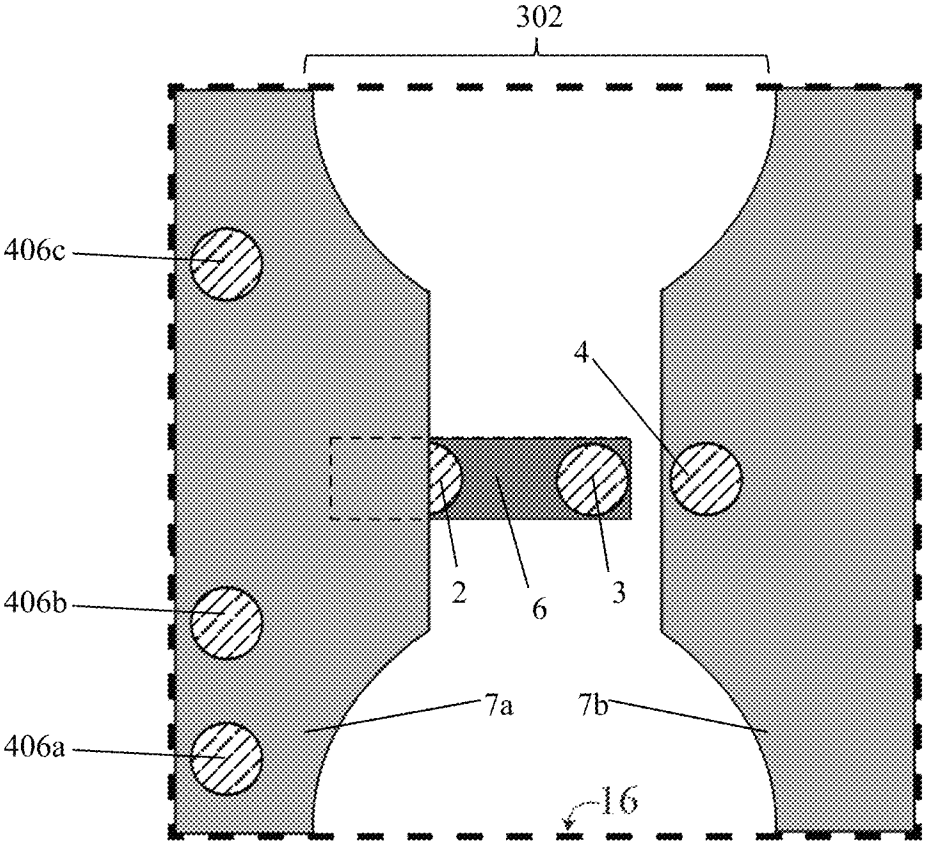
FIG. 15 is a diagram of a unit cell of a slot-based PUMA in accordance with an embodiment of the present disclosure.

FIG. 15 is a diagram of a unit cell of a slot-based PUMA in accordance with an embodiment of the present disclosure. In FIG. 15, a single-polarization operation is supported within an array unit cell 16. A contiguous plate 5, grounded by at least one grounding via 2, is present. A single excited dipole arm 6 on a separate layer couples to the plate 5. Arm 6 may also have its own grounded via in this instance. Plate 5 may take an arbitrary shape, as shown by one such example in this instance to form a barbell-like slot.

Figure 16:
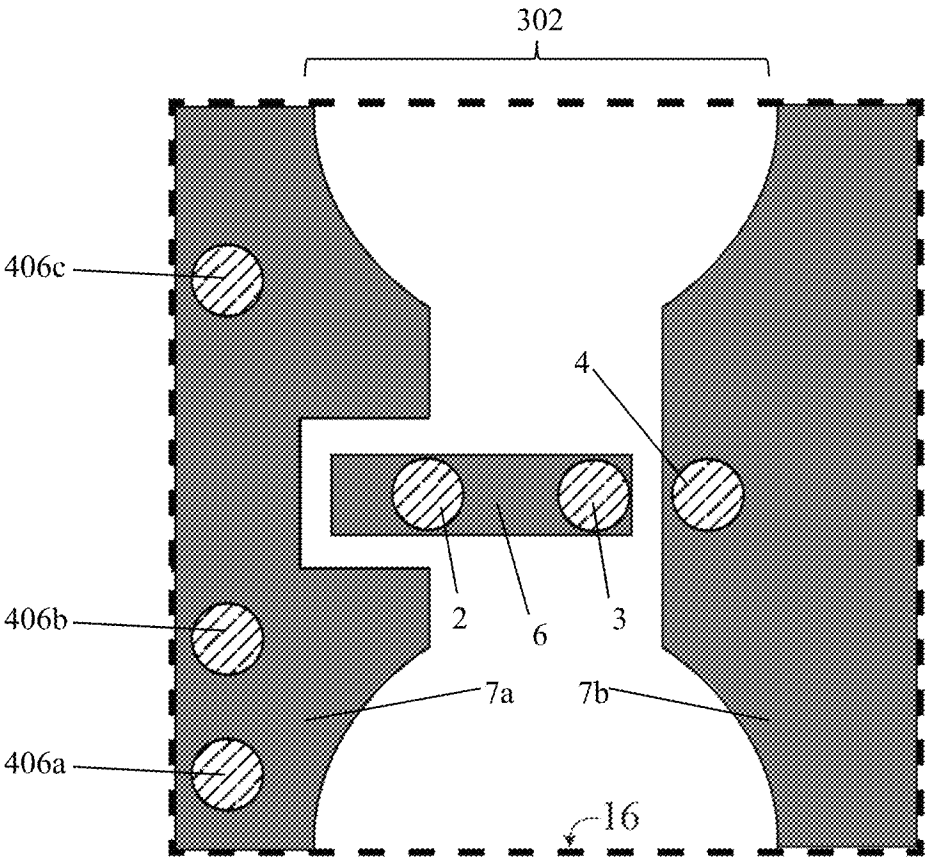
FIG. 16 is a diagram of a unit cell of a slot-based PUMA in accordance with an embodiment of the present disclosure.

FIG. 16 is a diagram of a unit cell of a slot-based PUMA in accordance with an embodiment of the present disclosure. In FIG. 16, a single-polarization operation is supported within an array unit cell 16. A contiguous plate 5, grounded by at least one grounding via 2, is present. A single excited dipole arm 6 on the same layer couples to the plate 5. Arm 6 may also have its own grounded via in this instance. Plate 5 may take an arbitrary shape, as shown by one such example in this instance to form a barbell-like slot.

Figure 17:
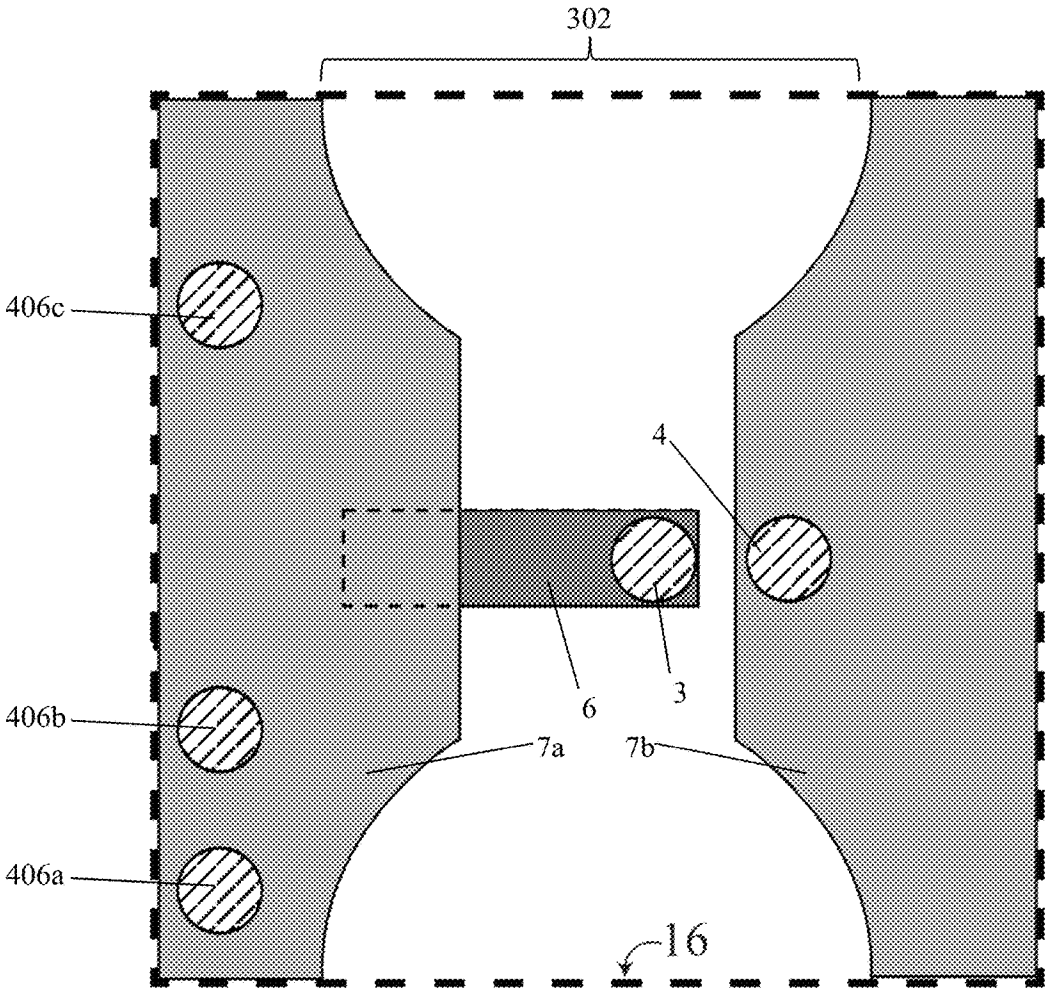
FIG. 17 is a diagram of a unit cell of a slot-based PUMA in accordance with an embodiment of the present disclosure.

FIG. 17 is a diagram of a unit cell of a slot-based PUMA in accordance with an embodiment of the present disclosure. In FIG. 17, a single-polarization operation is supported within an array unit cell 16. A contiguous plate 5, grounded by at least one grounding via 2, is present. A single excited dipole arm 6 on a separate layer couples to the plate 5. Arm 6 does not have its own grounded via in this instance. Plate 5 may take an arbitrary shape, as shown by one such example in this instance to form a barbell-like slot.

6. EXEMPLARY DUAL POLARIZATION EMBODIMENTS

Figure 18:
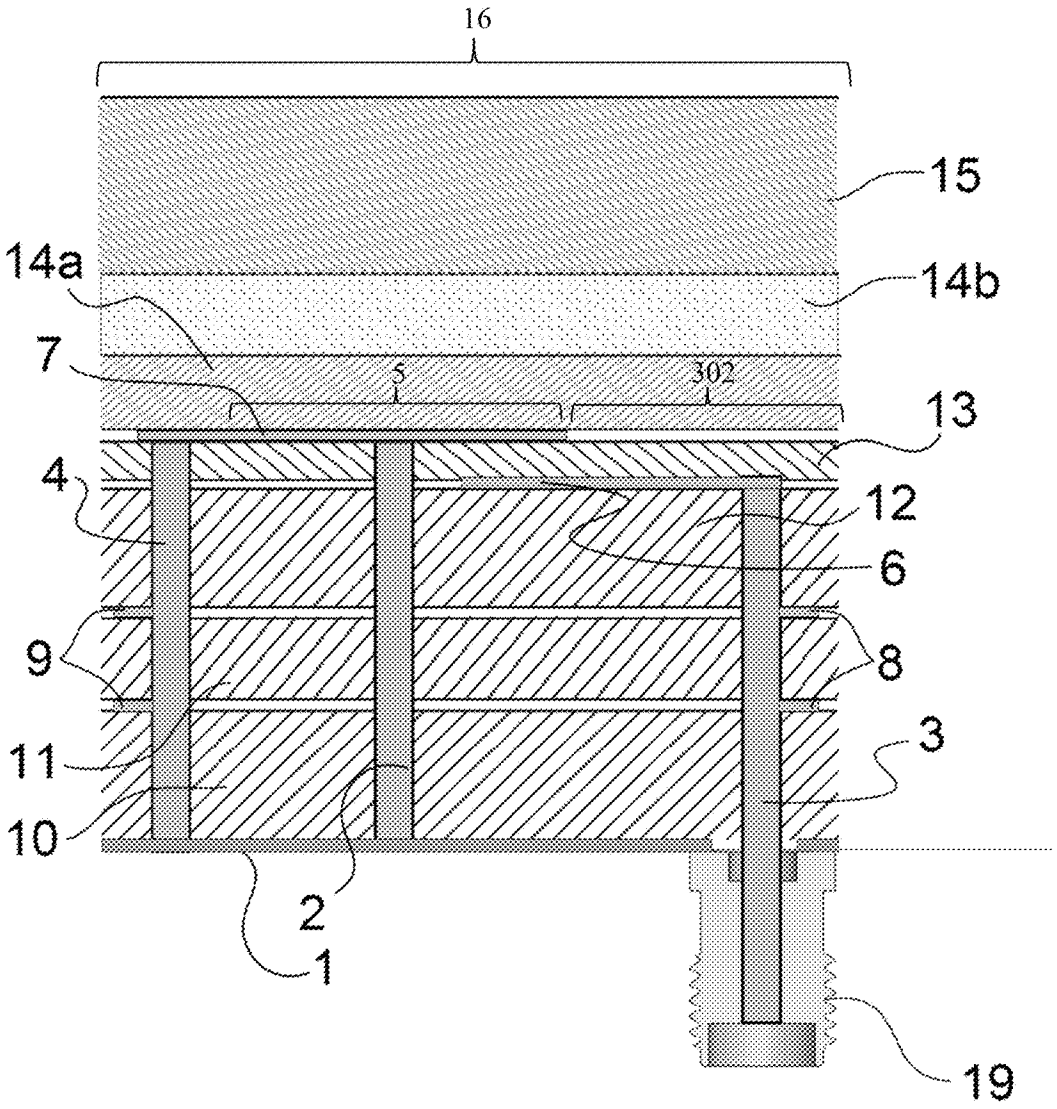
FIG. 18 is a diagram of a cross-section across a feed point of a unit cell of a slot-based PUMA array in accordance with an embodiment of the present disclosure.

FIG. 18 is a diagram of a cross-section across a feed point of a unit cell of a slot-based PUMA array in accordance with an embodiment of the present disclosure. In FIG. 18, vias 3 and 4 have ribs 8 and 9 (e.g., metallic ribs). For example, in an embodiment, ribs 8 and 9 enhance capacitive coupling between arms 6 and 7 and improve impedance performance in the transition from RF connector 19 to slot 302. The heightened capacitance between arms 6 and 7 and RF connector 19 also enables wider trace-trace gaps, via-to-via distances, via diameter-to-height aspect ratios, and thicker dielectric materials to be utilized that satisfy PCB standard manufacturing tolerances up to approximately Q-band (50 GHz).

Figure 19:
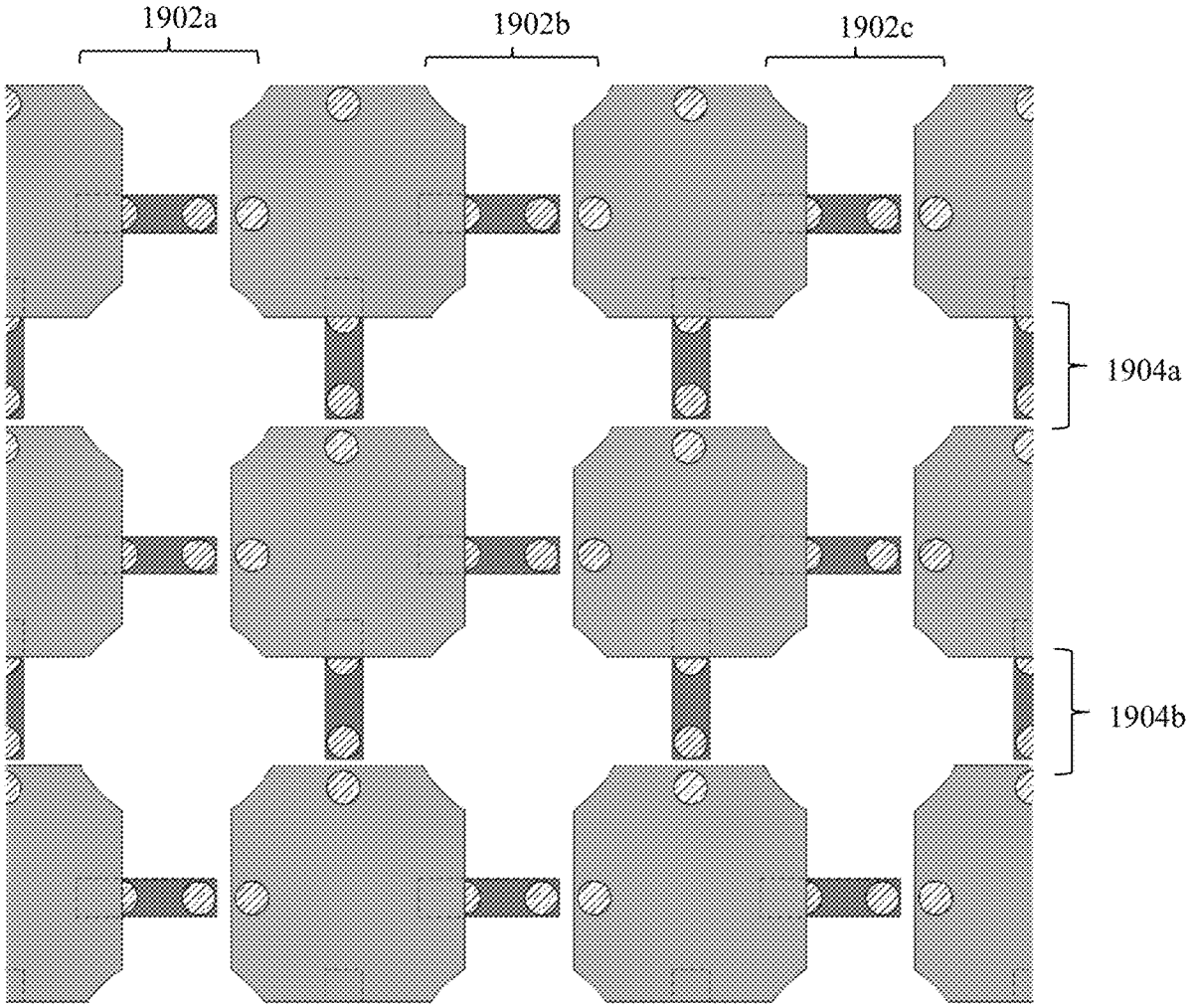
FIG. 19 is a top-down diagram of multiple unit cells of a slot-based PUMA array in accordance with an embodiment of the present disclosure.

FIG. 19 is a top-down diagram of multiple unit cells of a slot-based PUMA array in accordance with an embodiment of the present disclosure. In FIG. 19, a dual-polarization operation is supported. As shown by FIG. 19, in a dual polarization embodiment, slots can be created in both horizontal and vertical directions across multiple unit cells. For example, FIG. 19 shows vertical slots 1902*a*, 1902*b*, and 1902*c* and horizontal slots 1904*a* and 1904*b* extending across multiple unit cells.

Figure 20:
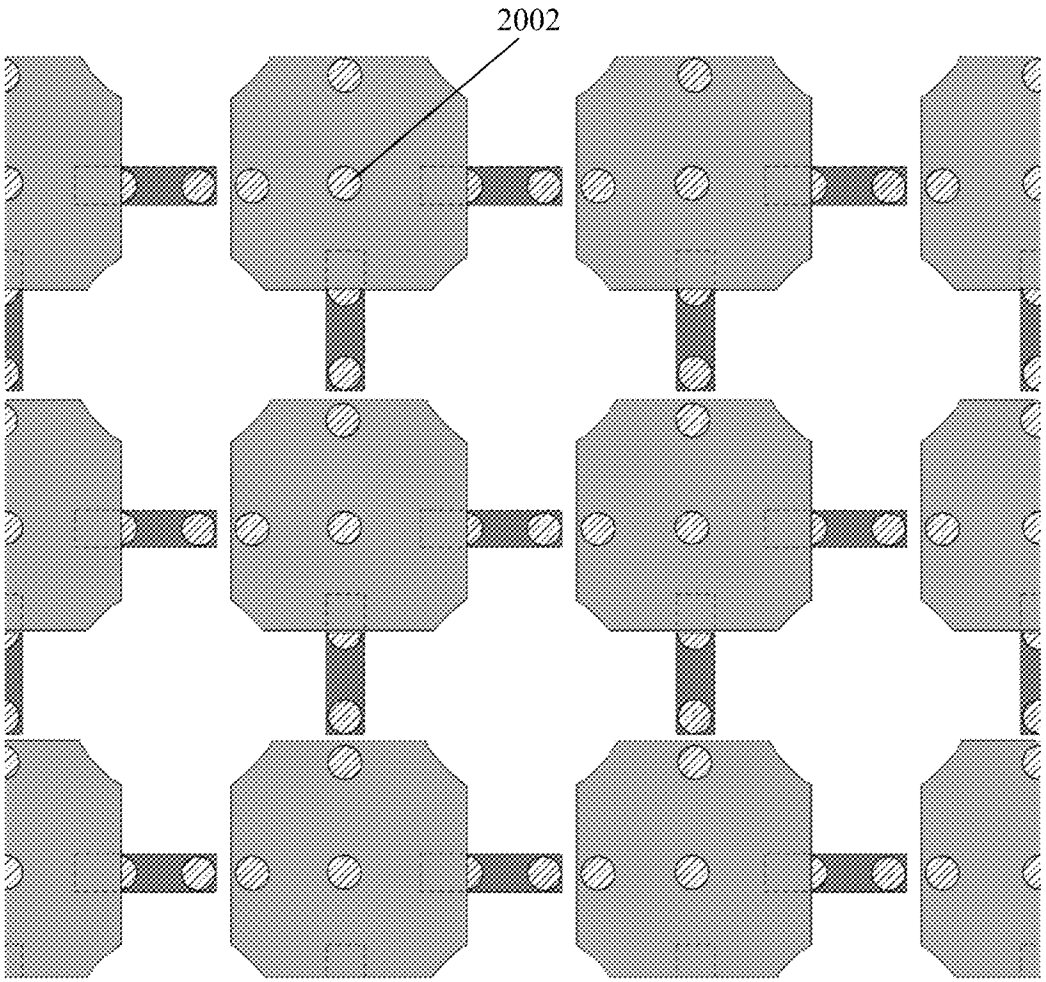
FIG. 20 is a top-down diagram of multiple unit cells of a slot-based PUMA array in accordance with an embodiment of the present disclosure.

FIG. 20 is a top-down diagram of multiple unit cells of a slot-based PUMA array in accordance with an embodiment of the present disclosure. In FIG. 20, vias (e.g., via 2002) are added to the center of plates in the array.

Figure 21:
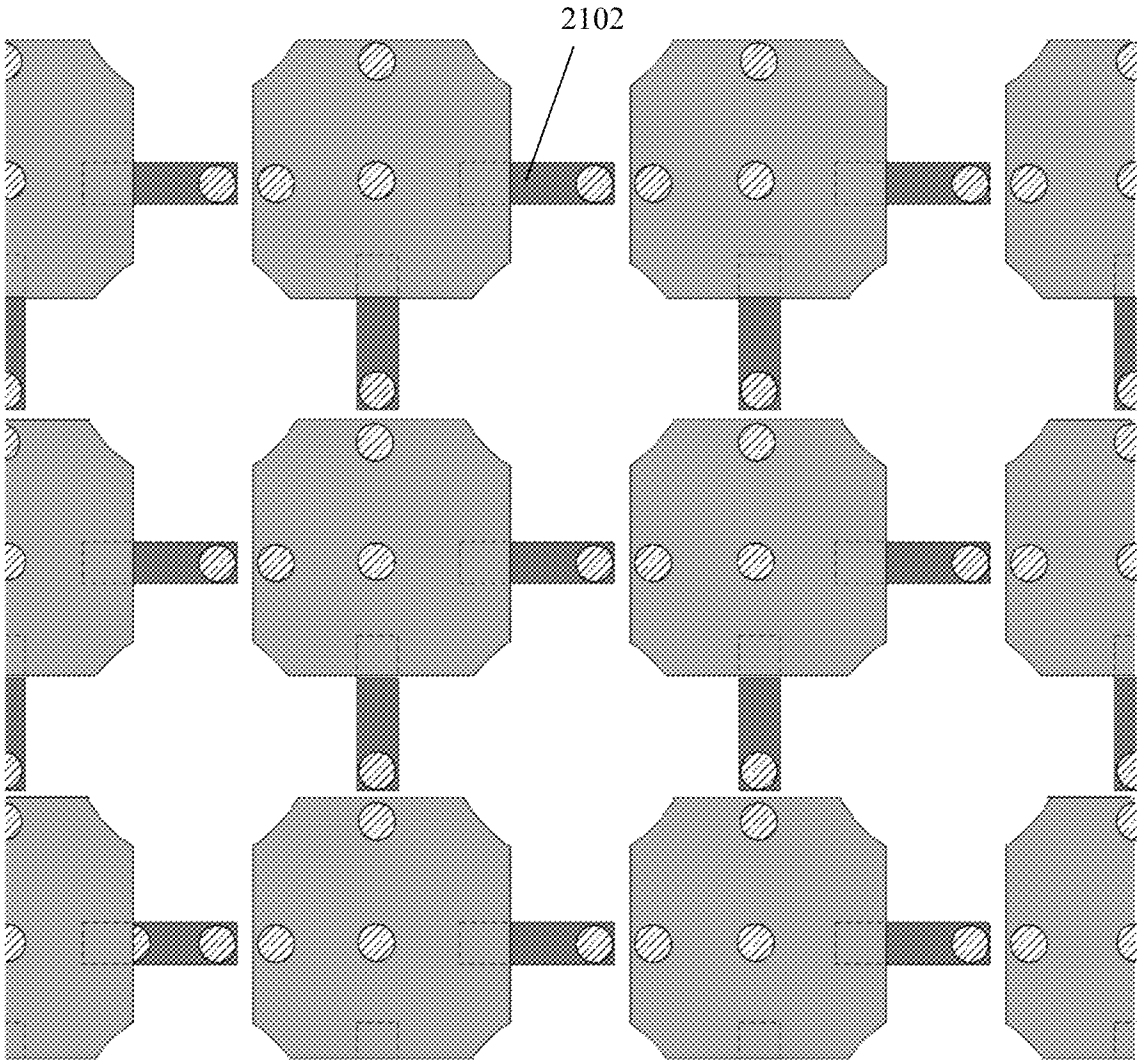
FIG. 21 is a top-down diagram of multiple unit cells of a slot-based PUMA array in accordance with an embodiment of the present disclosure.

FIG. 21 is a top-down diagram of multiple unit cells of a slot-based PUMA array in accordance with an embodiment of the present disclosure. In FIG. 21, dipole arms do not have their own grounded vias in this instance. For example, in FIG. 21, element 2102 points to an area of a dipole arm where a via would be in another embodiment having grounded vias.

7. EXEMPLARY ADVANTAGES

Embodiments of the present disclosure provide ultrawideband (UWB) array antenna geometry options that offer mechanical and power handling benefits with fabrication techniques, particularly at millimeter-wave frequencies. Embodiments of the present disclosure are further be more amenable than prior devices to the application of bandwidth/polarization-enhancing in planar-printed geometries. Systems and methods in accordance with embodiments of the present disclosure include a slot-coupled radiation mechanism (as opposed to dipoles). Embodiments of the present disclosure provide the first UWB (>3:1 bandwidth) planar-printed slot array.

8. CONCLUSION

It is to be appreciated that the Detailed Description, and not the Abstract, is intended to be used to interpret the claims. The Abstract may set forth one or more but not all exemplary embodiments of the present disclosure as contemplated by the inventor(s), and thus, is not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments.

What is claimed is:

1. A modular antenna array, comprising:
- a first via, coupled to a radio frequency (RF) input, configured to transmit a signal received from the RF input;
- a first arm coupled to the first via;
- a second via coupled to ground; and
- a second arm coupled to the second via, wherein a first portion of the second arm is positioned above a second portion of the first arm, thereby creating:
  - a capacitive coupling between the first arm and the second arm, and
  - a slot configured to radiate the signal from the unit cell.

2. The modular antenna array of claim 1, further comprising:
- a third via coupled to the first arm and to ground.

3. The modular antenna array of claim 1, further comprising:
- a superstrate, comprising a plurality of layers, coupled to the second arm, wherein respective thicknesses of each of the plurality of layers of the superstrate are configured based on tuning requirements of the modular antenna array.

4. The modular antenna array of claim 1, wherein the modular antenna array comprises a plurality of unit cells, and wherein a first unit cell in the plurality of unit cells comprises the first via, the first arm, the second via, and the second arm.

5. The modular antenna array of claim 4, wherein the slot is created in a gap between the second arm and an adjacent arm of a second unit cell that is adjacent to the first unit cell.

6. The modular antenna array of claim 4, wherein the first unit cell further comprises:
- a third via, coupled to a second RF input, configured to transmit a second signal received from the second RF input; and
- a third arm coupled to the third via, wherein a second portion of the second arm is positioned above a third portion of the third arm, thereby creating:
  - a second capacitive coupling between the second arm and the third arm, and
  - a second slot configured to radiate the second signal.

7. The modular antenna array of claim 4, wherein a width of the slot varies across a length of the unit cell.

8. The modular antenna array of claim 4, wherein the slot between the first unit cell and a second unit cell adjacent to the first unit cell forms a circular area.

9. The modular antenna array of claim 4, further comprising:
- a third via coupled to the second arm and to ground.

10. The modular antenna array of claim 4, further comprising:
- a fourth via coupled to the second arm and to ground, wherein the third via and the fourth via are spaced approximately a quarter wavelength apart.

11. A modular antenna array comprising a plurality of unit cells, the plurality of unit cells comprising:
- a first unit cell, comprising:
  - a first via, coupled to a radio frequency (RF) input, configured to transmit a signal received from the RF input,
  - a first arm coupled to the first via,
  - a second via coupled to ground, and
  - a second arm coupled to the second via, wherein a first portion of the second arm is positioned above a second portion of the first arm, thereby creating a capacitive coupling between the first arm and the second arm; and
- a second unit cell adjacent to the first unit cell, wherein the second unit cell comprises:
  - a third via coupled to ground, and
  - a third arm coupled to the third via, wherein the third arm is parallel with the second arm, and wherein a gap between the second arm and the third arm forms a slot configured to radiate the signal.

12. The modular antenna array of claim 11, wherein the second unit cell further comprises:
- a fourth via, coupled to a second RF input, configured to transmit a second signal received from the second RF input; and
- a fourth arm coupled to the fourth via, wherein the modular antenna array is configured to radiate the second signal through a slot formed between the fourth arm and a fifth arm of a third unit cell that is adjacent to the second unit cell.

13. The modular antenna array of claim 11, wherein the second unit cell is positioned to the right of the first unit cell.

14. The modular antenna array of claim 11, further comprising:
- a third unit cell positioned above the first unit cell, wherein the second arm extends into the third unit cell.

15. A modular antenna array comprising a plurality of unit cells, the modular antenna array comprising:
- a plurality of arms; and
- a plurality of slots formed between respective arms in the plurality of arms, wherein respective slots in the plurality of slots are configured to radiate respective signals in a plurality of signals, and wherein a first unit cell in the plurality of unit cells comprises:
  - a first via, coupled to a radio frequency (RF) input, wherein the RF input is configured to receive a first signal in the plurality of signals;
  - a first arm coupled to the first via;
  - a second via coupled to ground; and
  - a second arm in the plurality of arms, wherein the second arm is coupled to the second via, and wherein a first portion of the second arm is positioned above a second portion of the first arm, thereby creating:

a capacitive coupling between the first arm and the second arm, and a first slot in the plurality of slots.

16. The modular antenna array of claim 15, wherein the plurality of slots comprise a plurality of horizontal slots formed between respective arms in the plurality of arms.

17. The modular antenna array of claim 15, wherein the plurality of slots comprise a plurality of vertical slots formed between respective arms in the plurality of arms.

18. The modular antenna array of claim 15, wherein the plurality of slots comprise:

a plurality of vertical slots formed between respective arms in the plurality of arms; and a plurality of horizontal slots formed between respective arms in the plurality of arms.

19. The modular antenna array of claim 15, wherein the modular antenna array is a single-polarized modular antenna array.

20. The modular antenna array of claim 15, wherein the modular antenna array is a dual-polarized modular antenna array.

* * * * *